US009519257B2

(12) United States Patent
Sengoku et al.

(10) Patent No.: US 9,519,257 B2
(45) Date of Patent: Dec. 13, 2016

(54) CLEANING DEVICE AND IMAGE FORMING APPARATUS INCORPORATING SAME

(71) Applicants: Kenji Sengoku, Kanagawa (JP); Kazuki Yogosawa, Kanagawa (JP); Mitsuru Takahashi, Kanagawa (JP); Seiichi Kogure, Kanagawa (JP); Kenji Sugiura, Kanagawa (JP); Hiroyoshi Haga, Kanagawa (JP); Junpei Fujita, Kanagawa (JP); Takehide Mizutani, Tokyo (JP); Tatsuya Ohsugi, Kanagawa (JP); Yuuji Wada, Kanagawa (JP)

(72) Inventors: Kenji Sengoku, Kanagawa (JP); Kazuki Yogosawa, Kanagawa (JP); Mitsuru Takahashi, Kanagawa (JP); Seiichi Kogure, Kanagawa (JP); Kenji Sugiura, Kanagawa (JP); Hiroyoshi Haga, Kanagawa (JP); Junpei Fujita, Kanagawa (JP); Takehide Mizutani, Tokyo (JP); Tatsuya Ohsugi, Kanagawa (JP); Yuuji Wada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/003,938

(22) Filed: Jan. 22, 2016

(65) Prior Publication Data

US 2016/0216682 A1 Jul. 28, 2016

(30) Foreign Application Priority Data

Jan. 23, 2015 (JP) ..... 2015-011359

(51) Int. Cl.
*G03G 15/16* (2006.01)
*G03G 21/00* (2006.01)

(52) U.S. Cl.
CPC ..... *G03G 21/00* (2013.01)

(58) Field of Classification Search
USPC ..... 399/91, 98–105, 107, 110, 123, 343–345,399/350, 351, 358, 360; 15/256.5
See application file for complete search history.

(56) References Cited

U.S. PATENT DOCUMENTS 4,910,560 A * 3/1990 Kanada ..... G03G 21/0052 15/256.5
6,115,565 A * 9/2000 Noda ..... G03G 21/007 399/102

(Continued)

FOREIGN PATENT DOCUMENTS

| | | |
|---|---|---|
| JP | 1-312580 | 12/1989 |
| JP | 2009-244331 | 10/2009 |
| JP | 2012-208485 | 10/2012 |

*Primary Examiner* — Hoan Tran
(74) *Attorney, Agent, or Firm* — Oblon, McClelland, Maier & Neustadt, L.L.P.

(57) ABSTRACT

A cleaning device includes a cleaner, a casing, and an exit seal. The cleaner is configured to remove toner from a cleaning target. The casing accommodates the cleaner. The exit seal is attached to the casing and has a free end contacting the cleaning target at a position downward from the cleaner in a direction of movement of the cleaning target and an attached end attached to the casing. A space is disposed between a surface of the cleaning target and an opposite face of the exit seal opposite the cleaning target. The space includes an opening at a lateral end of the exit seal. The exit seal contacts the cleaning target from a trailing direction of the exit seal and seals the opening at at least an attached end side of the exit seal.

11 Claims, 7 Drawing Sheets

(56) References Cited

U.S. PATENT DOCUMENTS

| | | | | |
|---|---|---|---|---|
| 2007/0217843 | A1* | 9/2007 | Ichikawa | G03G 21/0011 399/350 |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |
| 2011/0229234 | A1 | 9/2011 | Hozumi et al. | |
| 2012/0008973 | A1 | 1/2012 | Sakakibara et al. | |
| 2012/0034006 | A1 | 2/2012 | Asaoka et al. | |
| 2012/0087704 | A1 | 4/2012 | Asaoka et al. | |
| 2012/0099883 | A1 | 4/2012 | Kikuchi et al. | |
| 2012/0224870 | A1 | 9/2012 | Kikuchi et al. | |
| 2013/0315617 | A1 | 11/2013 | Sugiura et al. | |
| 2013/0336694 | A1* | 12/2013 | Kadota | G03G 21/0058 399/349 |
| 2014/0064769 | A1 | 3/2014 | Sugiura | |
| 2014/0072326 | A1* | 3/2014 | Yamaguchi | G03G 21/0011 399/102 |
| 2014/0086618 | A1* | 3/2014 | Shimizu | G03G 21/0029 399/102 |
| 2014/0147181 | A1 | 5/2014 | Sugiura et al. | |
| 2014/0314461 | A1 | 10/2014 | Ishizuka et al. | |
| 2014/0321874 | A1 | 10/2014 | Sugiura et al. | |
| 2015/0147074 | A1 | 5/2015 | Wada et al. | |
| 2015/0205248 | A1 | 7/2015 | Yogosawa et al. | |
| 2015/0261137 | A1 | 9/2015 | Mitani et al. | |

* cited by examiner

CLEANING DEVICE AND IMAGE FORMING APPARATUS INCORPORATING SAME

CROSS-REFERENCE TO RELATED APPLICATION

This patent application is based on and claims priority pursuant to 35 U.S.C. §119(a) to Japanese Patent Application No. 2015-011359, filed on Jan. 23, 2015, in the Japan Patent Office, the entire disclosure of which is incorporated by reference herein.

BACKGROUND

1. Technical Field

Aspects of the present disclosure relate to a cleaning device and an image forming apparatus.

2. Related Art

Image forming apparatuses, such as printers, facsimile machines, and copiers, may include a cleaning device that accommodates a cleaner in a casing and removes post-transfer residual toner on an image bearer with the cleaner. Such a cleaning device includes, for example, an entry seal, an exit seal, and side seals attached to a casing to prevent toner floating in the casing from being scattered to the outside of the casing.

SUMMARY

In an aspect of this disclosure, there is provided a cleaning device that includes a cleaner, a casing, and an exit seal. The cleaner is configured to remove toner from a cleaning target. The casing accommodates the cleaner. The exit seal is attached to the casing and has a free end contacting the cleaning target at a position downward from the cleaner in a direction of movement of the cleaning target and an attached end attached to the casing. A space is disposed between a surface of the cleaning target and an opposite face of the exit seal opposite the cleaning target. The space includes an opening at a lateral end of the exit seal. The exit seal contacts the cleaning target from a trailing direction of the exit seal and seals the opening at at least an attached end side of the exit seal.

In another aspect of this disclosure, there is provided an image forming apparatus that includes an image bearer, a toner image forming unit, a transfer device, and the cleaning device. The image bearer has a surface to bear a toner image. The toner image forming unit is configured to form the toner image on the surface of the image bearer. The transfer device is configured to transfer the toner image from the surface of the image bearer onto a transfer target. The cleaning device is configured to remove toner from the surface of the image bearer.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

DETAILED DESCRIPTION

Figure 1:
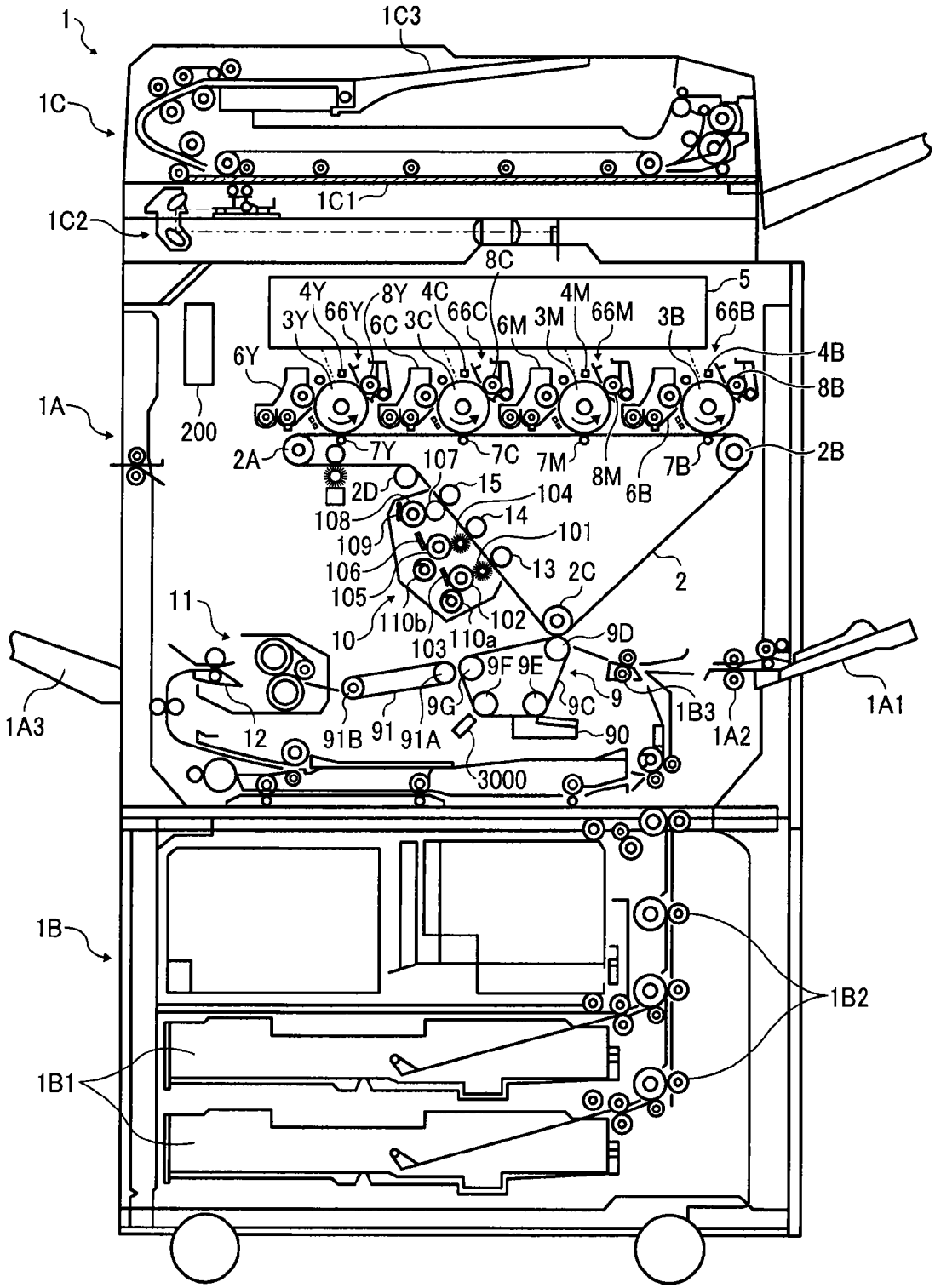
FIG. 1 is a schematic view of an entire configuration of an image forming apparatus according to an embodiment of the present disclosure.

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

A cleaning device includes, for example, an entry seal, an exit seal, and side seals attached to a casing to prevent toner floating in the casing from being scattered to the outside of the casing.

In such a cleaning device, for example, a free end of an exit seal is disposed upstream from an attached end of the exit seal in the direction of movement of the surface of the image bearer, and the free end of the exit seal contacts the image bearer from a counter direction opposite the direction of movement of the surface of the image bearer. The exit seal is typically made of a thin, less hard member, such as a film. When the exit seal contacts the image bearer from the counter direction, the friction force between the exit seal and the image bearer might curl the free end of the exit seal. Hence, the applicant of the present application has developed a cleaning device in which a free end of an exit seal is disposed downstream from an attached end of the exit seal in a direction of movement of the surface of an image bearer. In the cleaning device, the free end of the exit seal contacts the image bearer from a trailing direction, which is the same as the direction of movement of the surface of the image bearer. Such a configuration reduces occurrence of a failure of curing of the free end of the exit seal. However, for the cleaning device, the inventors have found that toner may be scattered from the casing at the exit side of the cleaning device.

By contrast, as described below, according to at least one embodiment of this disclosure, toner is prevented from being scattered from a casing at an exit side of a cleaning device.

FIG. 1 is a schematic view of an entire configuration of an image forming apparatus 1 according to an embodiment of the present disclosure. In FIG. 1, the image forming apparatus 1 is illustrated as a copier and has a configuration of a tandem system in which photoconductors 3 (3Y, 3C, 3M, and 3B) as latent image bearers to bear toner images of colors corresponding to color separation colors are disposed side by side. Tone images on the photoconductors 3 (3Y, 3C, 3M, and 3B) are superimposingly transferred one on another on an intermediate transfer belt 2 as an intermediate transferer being an image bearer (primary transfer), and the superimposed toner images are collectively transferred on a recording sheet as a recording material (second transfer). Thus, the image forming apparatus 1 forms a multi-color image on the recording sheet.

In FIG. 1, the image forming apparatus 1 includes an image forming section 1A, a sheet feed section 1B, and a document read section 1C. The image forming section 1A is disposed at a central portion in a vertical direction of the image forming apparatus 1. The sheet feed section 1B is disposed below the image forming section 1A. The document read section 1C is disposed above the image forming section 1A.

The image forming section 1A includes the intermediate transfer belt 2 having a horizontally stretched surface. In the image forming section 1A, the four photoconductors 3 (3Y, 3C, 3M, and 3B) to bear toner images of color toners (yellow, magenta, cyan, and black) complementary to each other are disposed side by side in a direction along the stretched surface of the intermediate transfer belt 2. In the following descriptions, for the contents common to all colors, color suffixes M, C, Y, and B may be omitted for simplicity.

The photoconductors 3 (3Y, 3C, 3M, and 3B) are drums that are rotatable in the same direction (counterclockwise in FIG. 1). A charging device 4, a writing device 5, a developing device 6, a primary transfer device, and a photoconductor cleaning device 8 to perform image forming processing during rotation of the photoconductor 3 are disposed around the photoconductor 3 to constitute an image forming unit 66.

The primary transfer device transfers toner images in turn from the photoconductors 3 (3Y, 3C, 3M, and 3B) onto the intermediate transfer belt 2. The intermediate transfer belt 2 is looped around a plurality of belt stretching rollers (2A, 2B, 2C, and 2D) and driven to rotate. The plurality of belt stretching rollers include a secondary transfer opposite roller 2C as a belt stretching roller other than the two belt stretching rollers 2A and 2*b* constituting the stretched surface. The secondary transfer opposite roller 2C is disposed opposite a secondary transfer device 9 via the intermediate transfer belt 2 and is applied with a bias having the same polarity as a polarity of toner. In addition, a tension roller 2D is provided as another belt stretching roller.

After secondary transfer, a belt cleaning device 10 removes post-transfer residual toner remaining on the intermediate transfer belt 2. The belt cleaning device 10 is an electrostatic cleaning system to apply a bias to a cleaning roller or a cleaning brush to electrostatically attract post-transfer residual toner on the intermediate transfer belt 2.

The secondary transfer device 9 includes a secondary transfer belt 9C looped around four secondary transfer belt support rollers (9D, 9E, 9F, and 9G). One of the secondary transfer belt support rollers is a drive roller driven to rotate the secondary transfer belt 9C counterclockwise in FIG. 1. The image forming apparatus 1 illustrated in FIG. 1 includes a conveyor belt 91 between the secondary transfer belt 9C and a fixing device 11. The conveyor belt 91 is looped around a conveyor belt drive roller 91A and a conveyor belt driven roller 91B. When the conveyor belt drive roller 91A is driven to rotate, the conveyor belt 91 is rotated counterclockwise in FIG. 1.

An optical sensor unit 3000 is disposed opposite a surface of the secondary transfer belt 9C at a position downstream from a secondary transfer portion, at which the secondary transfer belt 9C opposes the intermediate transfer belt 2, in a direction (indicated by arrow BTD in FIG. 4) of travel (rotation) of the surface of the secondary transfer belt 9C. A secondary transfer belt cleaning device 90 to remove foreign substances from the surface of the secondary transfer belt 9C is disposed downstream from the position, at which the optical sensor unit 3000 is disposed opposite the surface of the secondary transfer belt 9C, in the direction BTD of travel of the surface of the secondary transfer belt 9C.

One of the secondary transfer belt support rollers is the secondary transfer roller 9D opposite the secondary transfer opposite roller 2C, which is to be applied with a secondary transfer bias having the same polarity as the polarity of toner on the intermediate transfer belt 2, via the secondary transfer belt 9C and the intermediate transfer belt 2 at the secondary transfer portion. The secondary transfer belt support roller at the left side of the secondary transfer roller 9D in FIG. 1 is a separation roller 9E that stretches the secondary transfer belt 9C at a sheet separation portion at which, after passing the secondary transfer portion, a recording sheet borne on the surface of the secondary transfer belt 9C moves onto the conveyor belt 91. The secondary transfer belt support roller below the separation roller 9E is a sensor opposite roller 9F that stretches the secondary transfer belt 9C at a detection position at which the secondary transfer belt 9C opposes the optical sensor unit 3000. The secondary transfer belt support roller at the right side of the sensor opposite roller 9F in FIG. 1 is a secondary transfer belt cleaning opposite roller 9G that stretches the secondary transfer belt 9C at a position at which a cleaning blade of the secondary transfer belt cleaning device 90 contacts the secondary transfer belt 9C.

In this embodiment, the secondary transfer belt 9C is a belt of a single-layer structure. The secondary transfer belt 9C is made of, for example, a single layer of a moderate resistance resin having a resistance adjusted by dispersing carbon or blending ion conductant into a material, such as polyimide (PI), polyamideimide (PAI), polycarbonate (PC), ethylene-tetrafluoroethylene (ETFE), polyvinylidene difluoride (PVDF), or polyphenylene sulfide (PPS). Alternatively, a surface layer having a volume resistivity slightly higher than the volume resistivity of the single layer may be disposed only on the outer surface side of the secondary transfer belt 9C having the single-layer structure. In such a case, the thickness of the surface layer is, preferably, about 1 μm to about 10 μm.

In the image forming apparatus 1 according to this embodiment, when one of the four secondary transfer belt support rollers is driven to rotate as a drive roller, the surface of the secondary transfer belt 9C is moved (rotated) in the same direction as the intermediate transfer belt 2 at the secondary transfer portion at which the secondary transfer belt 9C contacts the intermediate transfer belt 2. The secondary transfer roller 9D, though depending on the bias characteristics of the primary transfer device, may have charging characteristics to electrostatically attract a recording sheet. In a process of conveying the recording sheet with the secondary transfer belt 9C, the secondary transfer device 9 transfers superimposed toner images or a single-color toner image from the intermediate transfer belt 2 onto the recording sheet.

The recording sheet is fed from the sheet feed section 1B to the secondary transfer device 9. The sheet feed section 1B includes a plurality of sheet feed trays 1B1 and a plurality of conveyance rollers 1B2 disposed at a delivery path of recording sheets fed from the sheet feed trays 1B1. A tiltable bypass tray 1A1 and feed rollers 1A2 are disposed at a wall of the image forming section 1A. A delivery path of a recording sheet fed from the bypass tray 1A1 joins to a course of the delivery path of a recording sheet from the sheet feed tray 1B1 to the registration rollers 1B3. The registration rollers 1B3 upstream from the secondary transfer portion in the direction of delivery of the recording sheet determines registration timing for the recording sheet fed from any of the delivery paths.

The writing light of the writing device 5 is controlled in accordance with image data obtained by scanning of a document on a document table 1C1 of the document read section 1C or output from a computer. The writing device 5 forms electrostatic latent images onto the photoconductors 3 (3Y, 3C, 3M, and 3B) in accordance with image data.

The document read section 1C includes a scanner 1C2 to expose and scan a document on the document table 1C1 with light. An automatic document feeder 1C3 is disposed on an upper face of the document table 1C1. The automatic document feeder 1C3 has a configuration of reversing a document fed onto the document table 1C1 and scanning both front and back sides of the document.

The electrostatic latent images formed on the photoconductors 3 (3Y, 3C, 3M, and 3B) with the writing device 5 are developed with the developing devices 6 (6Y, 6C, 6M, and 6B). The developed images are primarily transferred onto the intermediate transfer belt 2. When toners images of the respective colors are superimposingly transferred onto the intermediate transfer belt 2, the superimposingly transferred toner images are secondarily transferred collectively onto the recording sheet with the secondary transfer device 9.

After secondary transfer, unfixed images on the surface of the recording sheet is fixed with the fixing device 11. The fixing device 11 has a belt fixing structure including a fixing belt to be heated with a heating roller and a pressure roller disposed opposite and in contact with the fixing belt. A contact area, in other words, a nip area between the fixing belt and the pressure roller allows a heating area for the recording sheet to be more extended than a heating area in a fixing structure of other roller system. When the recording sheet passes out the fixing device 11, a delivery path switcher 12 downstream from the fixing device 11 switches the direction of delivery of the recording sheet, and the recording sheet is fed to a sheet ejection tray 1A3 or the registration rollers 1B3 again after reversed.

In the image forming apparatus 1 illustrated in FIG. 1, the primary transfer device as a transfer device includes primary transfer rollers 7 (7Y, 7C, 7M, and 7B) to be applied with a transfer bias of a positive polarity. Elastic bodies, such as bearings and compression springs, press the primary transfer rollers 7 (7Y, 7C, 7M, and 7B) against the photoconductors 3 (3Y, 3C, 3M, and 3B) via the intermediate transfer belt 2. With rotation of the intermediate transfer belt 2, the primary transfer rollers 7 (7Y, 7C, 7M, and 7B) rotate at positions offset in the direction of travel of the surface of the intermediate transfer belt 2 by about 1 mm to about 2 mm from positions opposite the central positions of the photoconductors 3 (3Y, 3C, 3M, and 3B). Such a configuration prevents a pre-transfer in which a transfer by a transfer bias is started before a normal transfer position and an abnormal image, such as an image flow, arises.

The primary transfer rollers 7 (7Y, 7C, 7M, and 7B) has a configuration in which, for example, a rubber material having electric characteristics of moderate resistance is rolled around a cored bar. In this embodiment, the primary transfer rollers 7 are made of a moderate resistance foamed rubber having a volume resistivity of from $10^6$ Ω·cm to $10^{10}$ Ω·cm, preferably from $10^7$ Ω·cm to $10^9$ Ω·cm. Note that the material is not limited to foamed rubber, and for example, a moderate resistance solid rubber can be used as well.

A constant-current controlled power supply applies a primary transfer voltage of a positive polarity to the primary transfer rollers 7 (7Y, 7C, 7M, and 7B), and the setting value of the electric current (the setting value of the primary transfer current) is controlled to be in a range of from about 10 μA to about 40 μA. The application of the primary transfer voltage to the primary transfer rollers 7 (7Y, 7C, 7M, and 7B) forms a primary transfer electric field in a primary transfer portion between the photoconductors 3 (3Y, 3C, 3M, and 3B) and the intermediate transfer belt 2. The primary transfer electric field is a primary transfer electric field acting in a direction to attract toner (of the negative polarity) from the photoconductors 3 (3Y, 3C, 3M, and 3B) to the intermediate transfer belt 2.

A constant-current controlled power supply applies a secondary transfer voltage of a negative polarity to the secondary transfer opposite roller 2C. In the configuration in which the secondary transfer opposite roller 2C is applied with the secondary transfer voltage, the secondary transfer belt support roller 9D as the drive roller is electrically earthed. The secondary transfer opposite roller 2C is disposed opposite the secondary transfer belt support roller 9D earthed, and thus a secondary transfer electric field in a direction to push toner (of the negative polarity) from the intermediate transfer belt 2 to the recording sheet is formed in the secondary transfer portion.

The intermediate transfer belt 2 used in this embodiment is an elastic intermediate transfer belt constituted of a three-layer belt having a base layer of from 50 μm to 100 μm, an elastic layer of from 100 μm to 500 μm on the base layer, and a surface layer on the elastic layer. The base layer is made of, for example, a moderate resistance resin having a resistance adjusted by dispersing carbon or blending ion conductant into a material, such as polyimide (PI), polyamideimide (PAI), polycarbonate (PC), ethylene-tetrafluoroethylene (ETFE), polyvinylidene difluoride (PVDF), or polyphenylene sulfide (PPS). The elastic layer includes, for example, a material having a resistance adjusted by dispersing carbon or blending ion conductant into a rubber material, such as urethane, nitrile rubber (NBR), or chloroprene rubber (CR). As the surface layer, for example, coating of fluorinated rubber or fluorinated resin (or a hybrid material thereof) having a thickness of from about 1 μm to about 10 μm is disposed on the surface of the elastic layer.

In this embodiment, the intermediate transfer belt 2 has a volume resistivity of from $10^6$ Ω·cm to $10^{10}$ Ω·cm, preferably from $10^8$ Ω·cm to $10^{10}$ Ω·cm. In this embodiment, the intermediate transfer belt 2 also has a surface resistivity of from $10^6$Ω/□ to $10^{12}$Ω/□, preferably from $10^8$Ω/□ to $10^{12}$Ω/□. Young's modulus (longitudinal elastic modulus) of the base layer is preferably not less than 3000 Mpa, and thus the base layer has a sufficient mechanical strength to endure extension, bending, folding, or waving due to driving. Using the elastic intermediate transfer belt 2 having such an elasticity allows the elastic layer to follow asperities of, for example, a sheet of paper having a low density of paper fibers or an embossed sheet having concave and convex portions of 20 μm to 30 μm in a surface thereof. Such a configuration enhances the transfer performance of toner to concave portions of the recording sheet, thus enhancing uniform filling performance.

The image forming apparatus 1 in this embodiment changes the contact state of the photoconductors 3 and the intermediate transfer belt 2 between a monochrome mode to form a monochromatic image and a color mode to form a color image.

Specifically, of the primary transfer rollers 7 (7Y, 7C, 7M, and 7B) of the primary transfer device, the primary transfer roller 7B for black is supported with a dedicated bracket, separately from the other primary transfer rollers 7Y, 7C, and 7M.

The primary transfer rollers 7Y, 7C, and 7M for yellow, cyan, and magenta, respectively, are supported with a common moving bracket. By driving of a solenoid, the common moving bracket is moved in a direction to approach or away from the primary transfer rollers 7Y, 7C, and 7M.

When the moving bracket is moved in the direction away from the primary transfer rollers 7Y, 7C, and 7M, the stretched attitude of the intermediate transfer belt 2 is changed, thus separating the intermediate transfer belt 2 from the primary transfer rollers 7Y, 7C, and 7M.

However, the photoconductor 3B for black and the intermediate transfer belt 2 remain in contact with each other. In the monochrome mode, as described above, image forming operation is performed with only the photoconductor 3B for black being in contact with the intermediate transfer belt 2.

When the moving bracket is moved in the direction to approach the primary transfer rollers 7Y, 7C, and 7M, the stretched attitude of the intermediate transfer belt 2 is changed, thus bringing the intermediate transfer belt 2, which is separated from the primary transfer rollers 7Y, 7C, and 7M, into contact with the primary transfer rollers 7Y, 7C, and 7M.

At this time, the photoconductor 3B for black and the intermediate transfer belt 2 remain in contact with each other. In the color mode, as described above, image forming operation is performed with all of the photoconductors 3 (3Y, 3C, 3M, and 3B) being in contact with the intermediate transfer belt 2.

In such a configuration, the moving bracket and the solenoid act as a contact-separation adjuster to contact and separate the photoconductors 3 and the intermediate transfer belt 2 with and from each other.

After Y, M, C, and B toner images are primarily transferred onto the intermediate transfer belt 2, the photoconductor cleaning devices 8 (8Y, 8C, 8M, and 8B) perform cleaning to remove post-transfer residual toner from the surfaces of the photoconductors 3 (3Y, 3C, 3M, and 3B). After electric neutralization is performed on the photoconductors 3 (3Y, 3C, 3M, and 3B) with neutralization lamps, the photoconductors 3 (3Y, 3C, 3M, and 3B) are uniformly electrically charged with the charging devices 4 (4Y, 4M, 4C, and 4B) to be ready for the next image formation.

The intermediate transfer belt 2 after the image is primarily transferred onto the recording sheet, a cleaning process of residual toner after transfer is performed by the belt cleaning device 10.

The image forming apparatus 1 according to this embodiment performs image-quality adjustment control at predetermined timing. For image-quality adjustment control, the image forming apparatus 1 forms a toner pattern and performs image density control and positional deviation control, based on results of detection of the image density and the image formed position of the toner pattern. In the image density control, for example, the image forming apparatus 1 detects a toner adhesion amount (image density) of a density control pattern (gradation pattern) obtained by developing predetermined patterned latent images. In accordance with the results of detection of the toner adhesion amount, the image forming apparatus 1 changes, for example, the toner density of developer in developing device, writing conditions (e.g., exposure power), and the setting values of charging bias and development bias. The positional deviation control adjusts the writing timing of latent images for respective color toners in accordance with the detection timing of a positional deviation control pattern (chevron patch).

The density control pattern is detected, for example, on a region of each photoconductor 3 from the development area to the primary transfer portion or on the intermediate transfer belt 2 after the density control pattern is primarily transferred. However, when the diameter of the photoconductors 3 is relatively small, it might be difficult to detect the pattern on the photoconductor due to a setting space of image density detection sensors. Therefore, the density control pattern is preferably detected on the intermediate transfer belt 2 or the secondary transfer belt 9C. The positional deviation control pattern is used to monitor position deviations between different color toners due to, for example, variations in distance between the photoconductors 3 and deviations in writing timings of latent images for difference colors. Accordingly, the positional deviation control pattern is detected on a surface travel body to bear toner images after the intermediate transfer belt 2. In this embodiment, both the density control pattern and the positional deviation control pattern are detected on the secondary transfer belt 9C.

A constraint to the intermediate transfer belt 2 is the followability of the surfaces of recording media having different surface properties in the secondary transfer portion to form images on various types of recording media, such as recording sheets. Regarding the surface followability, recently, full-color electrophotographic technologies have been increasingly developed to form images on various types of recording media. Not only normal smooth recording sheets of paper but also, for example, slipply recording media having high degrees of smoothness, such as coated paper, and recording media having rough surfaces, such as recycled paper, embossed paper, Japanese paper, and craft paper, have been increasingly used as the recording media If the surface followability of the intermediate transfer belt 2 relative to recording media having various surface properties in the secondary transfer portion is poor, uneven density or uneven color tone may arise in toner images transferred on recording media.

Figure 2:
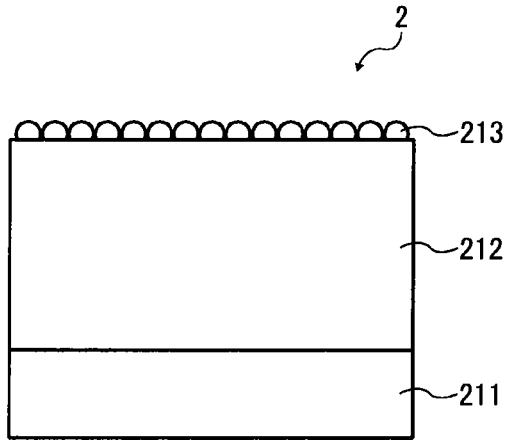
FIG. 2 is an enlarged cross-sectional view of a layer structure of an intermediate transfer belt.

An example of the intermediate transfer belt 2 having such followability to various recording media is illustrated in FIG. 2. FIG. 2 is an enlarged cross-sectional view of a layer structure of the intermediate transfer belt 2. The intermediate transfer belt 2 illustrated in FIG. 2 includes a rigid base layer 211 having relatively bendability, a flexible, elastic layer 212 on the base layer 211, and a surface layer 213 containing fine particles on the elastic layer 212.

First, a description is given of the base layer 211. The base layer 211 includes, for example, a resin material containing a filler (or an additive) for adjusting electric resistance, in other words, an electric resistance adjusting material. The resin material of the base layer 211 is preferably, for example, a fluorinated resin, such as PVDF or ETFE, a polyimide resin, or a polyamideimide resin in terms of fire resistance. In terms of mechanical strength (high elasticity) and heat resistance, specifically, a polyimide resin or a polyamideimide resin is more preferable. Examples of the electrical resistance adjusting material contained in the resin material of the base layer 211 include, but are not limited to, metal oxides, carbon blacks, ion conductive materials, and conductive polymers.

Next, a description is given of the elastic layer 212 on the base layer 211. An elastic rubber layer may be used as the elastic layer 212. For example, acrylic rubber may be used for the elastic layer 212. The acrylic rubber may be commercially-available one and is not limited to any specific acrylic rubber. However, among cross-linking systems (epoxy group, active chlorine group, and carboxyl group) of acrylic rubber, the cross-linking system of the carboxyl group is advantageous in rubber properties (in particular, compression set) and workability. The cross-linking system of the carboxyl group is preferably selected.

Next, a description is given of the surface layer 213 containing spherical resin fine particles on the elastic layer 212. The spherical resin fine particles are not limited to any particular materials, but may be spherical resin fine particles (hereinafter, also simply referred to as resin fine particles) containing, as a main component, a resin, such as an acrylic resin, a melamine resin, a polyamide resin, a polyester resin, a silicone resin, or a fluororesin. Alternatively, in some embodiments, the surfaces of the fine particles made of the resin materials may be treated with different types of materials.

The resin fine particles used herein include rubber materials. The surfaces of the spherical resin fine particles made of rubber material may be coated with hard resin. The shape of the resin fine particles may be hollow or porous. Of the above-described resin materials, silicone resin fine particles are most preferable in smoothness, releasability from toner, and abrasion resistance.

The resin fine particles to be used are preferably fine particles prepared in spherical shape by a polymerization method, and more preferably as the shape approaches a true sphere. The volume average particle diameter of the particle is preferably in a range from 0.5 μm to 5.0 μm, and the particle dispersion is monodisperse with a sharp distribution. If the volume average particle diameter is less than 0.5 μm, the fine particles strikingly aggregate together, thus hampering uniform application of the fine particles to the surface of the elastic layer of acrylic rubber. If the volume average particle diameter is 5 μm or greater, the asperities of the belt surface after application of the fine particles increases in size. When the fine particles are used as the surface layer of the intermediate transfer belt 2, cleaning failure might occur in the cleaning of the belt cleaning device 10.

The Martens hardness of the elastic layer 212 when pressed to a depth of 10 μm is in a range of from 0.2 $N/mm^2$ to 0.8 $N/mm^2$. The surface layer 213 on the outer surface of the elastic layer 212 are made of independent spherical resin particles arrayed in a surface direction to form uniform asperities. Such a configuration of the intermediate transfer belt 2 secures the releasability of toner from the surface layer 213 and obtains an excellent followability to the surfaces of different types of recording media in the secondary transfer portion. The elastic layer 212 is an elastic layer of fire-resistant acrylic rubber showing a result of VTM-0 in a UL94VTM combustion test, thus obtaining both excellent followability and excellent fire resistance.

The surface of the intermediate transfer belt 2 including the elastic layer 212 illustrated in FIG. 2 follows paper sheets having rough surfaces, thus reducing occurrence of uneven density or uneven color tone in different types of recording media and allowing excellent image formation. However, rubber materials constituting the elastic layer 212 are typically poor in the releasability from toner. Without a surface layer made of other materials having excellent releasability from toner, the secondary transfer rate or the cleaning performance might be so poor as not to be practically used. For an intermediate transfer belt including a typical elastic layer, a coat layer may be disposed on the surface of the elastic layer. For example, by applying and drying a liquid material of a coat layer on the surface of the elastic layer, an intermediate transfer belt can be formed that has the coat layer on the surface of the elastic layer. However, materials used for the coat layer may not deform following the deformation, such as extension and contraction, of rubber materials used for the elastic layer over time. If the belt is used over a long time, the belt surface may crack. Such cracks may degrade the transferability and cleaning performance of toner adhered to the cracks.

By contrast, the intermediate transfer belt 2 illustrated in FIG. 2 has a configuration in which the surface layer 213 is made of resin fine particles paved on the surface of the elastic layer 212. Accordingly, when the surface side of the elastic layer 212 deforms to extend, the resin fine particles of the surface layer 213 displace so as to increase spaces among adjacent resin fine particles. When the surface side of the elastic layer 212 deforms to contract, the resin fine particles of the surface layer 213 displace so as to reduce spaces among adjacent resin fine particles. Thus, even if rubber materials of the elastic layer 212 deform, only the positional relationships among the resin fine particles change and no cracks occur in the surface layer 213. Accordingly, the releasability from toner is stably maintained over time, thus enhancing the transferability and cleaning performance of toner.

In a combination of small particle size polymerization toner and an elastic intermediate transfer belt recently used to enhance image quality, it might be difficult to secure the cleaning performance of the belt cleaning device 10. For example, the belt cleaning device 10 collects color gradation patterns of Y, C, M, and B colors, chevron patches, and toner consumption patterns on the intermediate transfer belt 2. At this time, the belt cleaning device 10 removes from the intermediate transfer belt 2 a large amount of toner of untransferred toner images, such as color gradation patterns, chevron patches, and toner consumption patterns.

However, for the configuration of the present embodiment with a combination of small particle size polymerization toner and the elastic intermediate transfer belt, a cleaning device including a polarity controller and a brush roller or a cleaning device including two brush rollers for removing toner particles of positive and negative polarities may not remove untransferred toner images at a time from the intermediate transfer belt 2. In such a case, residual toner particles on the intermediate transfer belt 2 that cannot be completely cleaned are transferred onto a recording sheet in the next print operation, and an abnormal image may be formed.

Hence, for the image forming apparatus 1 according to the present embodiment, toner patterns, such as color gradation patterns of the respective colors, chevron patches, and toner consumption patterns, are transferred onto the secondary transfer belt 9C, and the secondary transfer belt cleaning device 90 removes untransferred toner particles from the secondary transfer belt 9C. Accordingly, only residual toner having not been secondarily transferred are left for the belt cleaning device 10, thus reducing the amount of toner input to the belt cleaning device 10. Such a configuration reduces occurrence of cleaning failure in the belt cleaning device 10, thus reducing occurrence of an abnormal image. The secondary transfer belt 9C is a belt having no elastic layer and easy to secure the cleaning performance. Accordingly, the image forming apparatus 1 according to the present embodiment excellently removes toner patterns, such as toner consumption patterns, transferred on the secondary transfer belt 9C, with the secondary transfer belt cleaning device 90.

Figure 3:
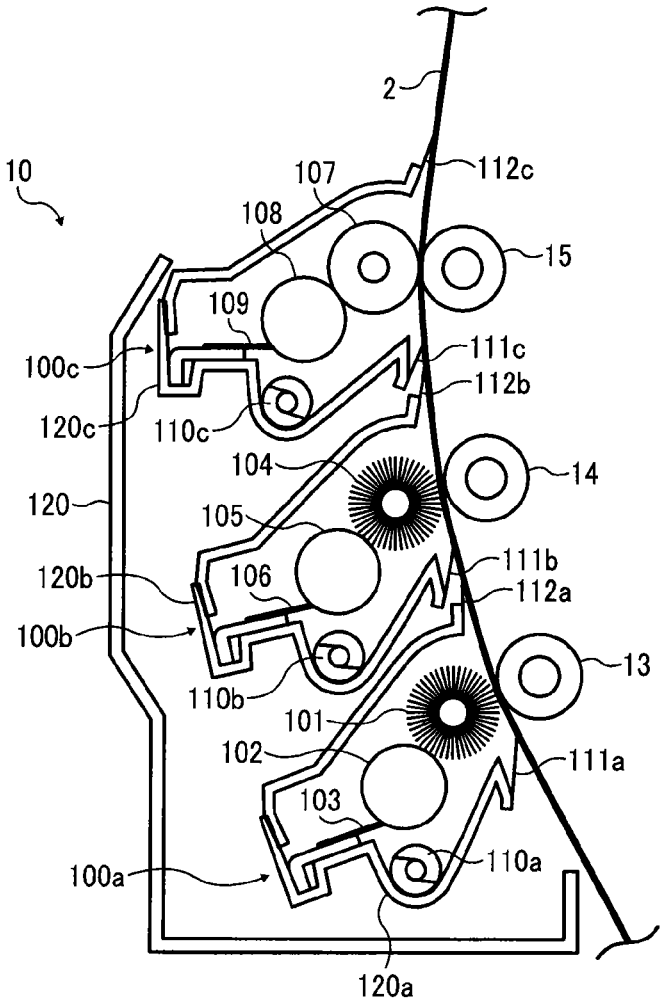
FIG. 3 is an enlarged view of a configuration of a belt cleaning device and a periphery thereof.

Next, a description is given of the belt cleaning device 10 in this embodiment. FIG. 3 is an enlarged view of a configuration of the belt cleaning device 10 of the image forming apparatus 1 and an area around the belt cleaning device 10 in this embodiment. In FIG. 3, the belt cleaning device 10 includes a first cleaning unit 100*a* and a second cleaning unit 100*b*. The second cleaning unit 100*b* is disposed adjacent to and downstream from the first cleaning unit 100*a* in the belt travel direction BTD of the intermediate transfer belt 2. The belt cleaning device 10 also includes a post cleaning unit 100*c* disposed adjacent to and downstream from the second cleaning unit 100*b* in the belt travel direction BTD.

In a first casing 120*a* of the first cleaning unit 100*a* is disposed a first cleaning brush roller 101 as a first cleaner to remove post-transfer residual toner from the surface of the intermediate transfer belt 2. In the first casing 120*a* of the first cleaning unit 100*a* are disposed a first collection roller 102 as a collection member to rotate while contacting the first cleaning brush roller 101 to collect post-transfer residual toner from the first cleaning brush roller 101 and a first scraping blade 103 to scrape post-transfer residual toner from the surface of the first collection roller 102. In the first casing 120*a* is disposed a first transport screw 110*a* to discharge post-transfer residual toner scraped from the first collection roller 102 to the outside of the first casing 120*a*. The first casing 120*a* is provided with an entry seal 111*a* and an exit seal 112*a* that contact the intermediate transfer belt 2 to prevent toner in the first casing 120*a* from being scattered to the outside of the first casing 120*a*.

Most of post-transfer residual toner having not been transferred from the secondary transfer belt 9C (e.g., about 80% of the post-transfer residual toner) are charged with the polarity opposite the normal charge polarity (the negative polarity). Hence, in this embodiment, a voltage of the normal charge polarity (the negative polarity) is applied to the first cleaning brush roller 101 to electrostatically remove toner of the positive polarity on the intermediate transfer belt 2. A voltage of the negative polarity higher than a voltage applied to the first cleaning brush roller 101 is applied to the first collection roller 102. In the belt cleaning device 10, a voltage applied to the first cleaning brush roller 101 and the like are set such that most of the post-transfer residual toner are removed with the first cleaning brush roller 101. Note that, in this case, some of the post-transfer residual toner may receive negative charge from the first cleaning brush roller 101 and have the normal charge polarity (the negative polarity).

Like the first cleaning unit 100*a*, a second casing 120*b* of the second cleaning unit 100*b* includes a second cleaning brush roller 104 as a second cleaner, a second collection roller 105, a second scraping blade 106, and a second transport screw 110*b* and is provided with an entry seal 111*b* and an exit seal 112*b*.

The second cleaning unit 100*b* removes post-secondary-transfer residual toner charged with the normal charge polarity (the negative polarity), which has not been removed with the first cleaning unit 100*a*, and toner of the normal charge polarity (the negative polarity), which has received negative charge from the first cleaning brush roller 101. For this reason, a positive voltage having a polarity (positive polarity) opposite the normal charge polarity of toner is applied to the second cleaning brush roller 104 to electrostatically remove toner of the negative polarity on the intermediate transfer belt 2. A voltage of the negative polarity higher than a voltage applied to the second cleaning brush roller 104 is applied to the second collection roller 105.

Each of the first cleaning brush roller 101 and the second cleaning brush roller 104 includes a metal rotation shaft rotationally supported and a brush. The brush is made of a plurality of raising fibers standing on the peripheral surface of the rotation shaft. Each of the first cleaning brush roller 101 and the second cleaning brush roller 104 has an external diameter $\phi$ of 15 mm to 16 mm. Each of the raising fibers has a two-layered core-sheath structure in which the inside of each of the raising fibers is made of a conductive material such as conductive carbon, and the surface portion of each of the rising fibers is made of an insulating material such as polyester. In this manner, the core has approximately the same potential as the potential of the cleaning bias applied to each of the first cleaning brush roller 101 and the second cleaning brush roller 104, thus allowing toner to be electrostatically attracted to the surfaces of the raising fibers. As a result, toner particles on the intermediate transfer belt 2 are electrostatically captured to the raising fibers of the first cleaning brush roller 101 and the second cleaning brush roller 104.

In some embodiments, the raising fibers of the first cleaning brush roller 101 and the second cleaning brush roller 104 are made of only conductive fibers, not the two-layered core-sheath structure. In some embodiments, fibers are planted to be slanted with respect to a normal direction of the rotation shaft of each of the first cleaning brush roller 101 and the second cleaning brush roller 104. In some embodiments, the raising fibers of the second cleaning brush roller 104 applied with a cleaning bias of negative polarity have core-sheath structures, and the raising fibers of the first cleaning brush roller 101 are made of only conductive fibers. When the raising fibers of the first cleaning brush roller 101 applied with a cleaning bias of negative polarity are made of only conductive fibers, charge injection from the first cleaning brush roller 101 to toner is facilitated. In this manner, the first cleaning brush roller 101 can equalize toner on the intermediate transfer belt 2 to the negative polarity. Further, when the raising fibers of the second cleaning brush roller 104 have the core-sheath structure, charge injection into toner can be reduced, thus reducing positive charging of the toner on the intermediate transfer belt 2. Such a configuration can reduce occurrence of toner not electrostatically removed with the second cleaning brush roller 104.

Each of the first cleaning brush roller 101 and the second cleaning brush roller 104 is disposed to press against the intermediate transfer belt 2 at a depth of 1 mm. Each of the first cleaning brush roller 101 and the second cleaning brush roller 104 is rotated by a driving unit such that the raising fibers move in a direction (counter direction) opposite the belt travel direction BTD of the intermediate transfer belt 2 at a contact position at which each of the first cleaning brush roller 101 and the second cleaning brush roller 104 contacts the intermediate transfer belt 2. At the contact position, each of the first cleaning brush roller 101 and the second cleaning brush roller 104 is rotated to move the rising fibers in the counter direction so that the difference in linear velocity between the intermediate transfer belt 2 and each of the first cleaning brush roller 101 and the second cleaning brush roller 104 can be increased. In this manner, a contact rate of a certain position of the intermediate transfer belt 2 with the raising fibers increases in a period during which a certain position of the intermediate transfer belt 2 passes through a contact area with each of the first cleaning brush roller 101 and the second cleaning brush roller 104, thus allowing toner to be excellently removed from the intermediate transfer belt 2.

The first cleaning brush roller 101 and the second cleaning brush roller 104 is disposed opposite a first cleaning opposite roller 13 and a second cleaning opposite roller 14, respectively, via the intermediate transfer belt 2. The first cleaning opposite roller 13 is also conductive and grounded to form a cleaning electric field between the first cleaning opposite roller 13 and the first cleaning brush roller 101. The second cleaning opposite roller 14 is also conductive and ground to form a cleaning electric field between the second cleaning opposite roller 14 and the second cleaning brush roller 104.

In this embodiment, each of the first collection roller 102 and the second collection roller 105 is made of stainless steel (SUS). In some embodiments, the first collection roller 102 and the second collection roller 105 are made of any other material capable of achieving the following function. The function is to transfer toner attracted to the first cleaning brush roller 101 and the second cleaning brush roller 104, from the first cleaning brush roller 101 and the second cleaning brush roller 104 to the first collection roller 102 and the second collection roller 105, respectively, by potential gradient between the raising fibers and each of the first collection roller 102 and the second collection roller 105. For example, in some embodiments, each of the first collection roller 102 and the second collection roller 105 has a roller resistance log R of from 12 Ω·cm to 14 Ω·cm obtained by, e.g., covering a conductive metal core with a high-resistance elastic tube having a size of from several micrometers to 100 micrometers or coating the conductive metal core with an insulator.

In FIG. 3, as the intermediate transfer belt 2 moves, post-secondary-transfer residual toner on the intermediate transfer belt 2 passes a contact portion at which the first entry seal 111*a* contacts the intermediate transfer belt 2, and moves to the position of the first cleaning brush roller 101. The first cleaning brush roller 101 is applied with a cleaning bias having the normal charge polarity (negative polarity) of toner. By action of an electric field formed by an electric difference in surface potential between the intermediate transfer belt 2 and the first cleaning brush roller 101, toner charged with positive polarity on the intermediate transfer belt 2 is electrostatically attracted to the brush of the first cleaning brush roller 101. At this time, some toner particles receive negative charges from the brush through charge injection or electric discharge, are charged with the normal polarity (negative polarity), and remain on the intermediate transfer belt 2.

Toner particles having the positive polarity attracted to the first cleaning brush roller 101 are moved to a contact position at which the first cleaning brush roller 101 contacts the first collection roller 102 applied with a collection bias having a negative polarity greater in absolute value than the first cleaning brush roller 101. By the electric field formed by the difference in surface potential between the first cleaning brush roller 101 and the first collection roller 102, post-transfer residual toner in the brush of the first cleaning brush roller 101 is electrostatically transferred onto the first collection roller 102. After scraped off from the surface of the first collection roller 102 with the first scraping blade 103, post-transfer residual toner is delivered with the first transport screw 110*a* from the first cleaning unit 100*a* to a toner storage portion.

Post-secondary-transfer residual toner on the intermediate transfer belt 2, which has not been removed with the first cleaning brush roller 101, is delivered to a contact position at which the second cleaning brush roller 104 contacts the intermediate transfer belt 2. The second cleaning brush roller 104 is applied with a voltage of the opposite polarity (positive polarity) to the normal charge polarity of toner. By the electric field formed by the difference in surface potential between the intermediate transfer belt 2 and the second cleaning brush roller 104, toner charged with the negative polarity on the intermediate transfer belt 2 is electrostatically attracted to the second cleaning brush roller 104. Then, after electrostatically transferred to the second collection roller 105, residual toner is scraped off from the second collection roller 105 with the second scraping blade 106 and delivered from the second cleaning unit 100*b* to a toner storage portion.

In this embodiment, most post-secondary-transfer residual toner can be removed with the first cleaning unit 100*a* and the second cleaning unit 100*b*. However, for a configuration in which the belt cleaning device 10 includes only the first cleaning unit 100*a* to electrostatically remove toner of the positive polarity and the second cleaning unit 100*b* to electrostatically remove toner of the negative polarity, a stain-shaped abnormal image may occur which might be caused by cleaning failure. For example, such stain-shaped abnormal images may occur in Y-color solid images formed with the image forming unit 66Y for yellow disposed most upstream of the plurality of image forming units 66 in the belt travel direction BTD of the intermediate transfer belt 2.

Through diligent studies of the above-described stain-shaped abnormal images, the inventors of the present application have found that toner particles may adhere from each of the first cleaning brush roller 101 and the second cleaning brush roller 104 to the intermediate transfer belt 2 again and such re-adhesion toner may appear as the stain-shaped abnormal image.

Hence, the belt cleaning device 10 according to this embodiment includes the post cleaning unit 100*c* downstream from the second cleaning unit 100*b* in the belt travel direction BTD of the intermediate transfer belt 2, to remove re-adhesion toner, which has been adhered from each of the first cleaning brush roller 101 and the second cleaning brush roller 104 to the intermediate transfer belt 2 again.

The post cleaning unit 100*c* includes, e.g., a post cleaning roller 107 made of conductive sponge to remove re-adhesion toner on the intermediate transfer belt 2, a post collection roller 108 as a collection member to rotate while contacting the post cleaning roller 107 to collect toner from the post cleaning roller 107, and a post scraping blade 109 to scrape post-transfer residual toner from the surface of the post collection roller 108. The post cleaning roller 107, the post collection roller 108, and the post scraping blade 109 are disposed in a post casing 120*c*. For example, a post transport screw 110*c* to discharge scraped toner to the outside of the post casing 120*c* is also disposed in the post casing 120*c*. The post casing 120*c* is provided with an entry seal 111*c* and an exit seal 112*c* that contact the intermediate transfer belt 2 to prevent toner in the post casing 120*c* from being scattered to the outside of the post casing 120*c*.

The post cleaning roller 107 is applied with a voltage of the positive polarity much greater in absolute value than a voltage applied to each of the first cleaning brush roller 101 and the second cleaning brush roller 104. The post collection roller 108 is applied with a voltage of the positive polarity greater than the voltage applied to the post cleaning roller 107. The post cleaning roller 107 is disposed opposite a post cleaning opposite roller 15 via the intermediate transfer belt 2. The post cleaning opposite roller 15 is electrically conductive and grounded to from a cleaning electric field between the post cleaning opposite roller 15 and the post cleaning roller 107.

Figure 4:
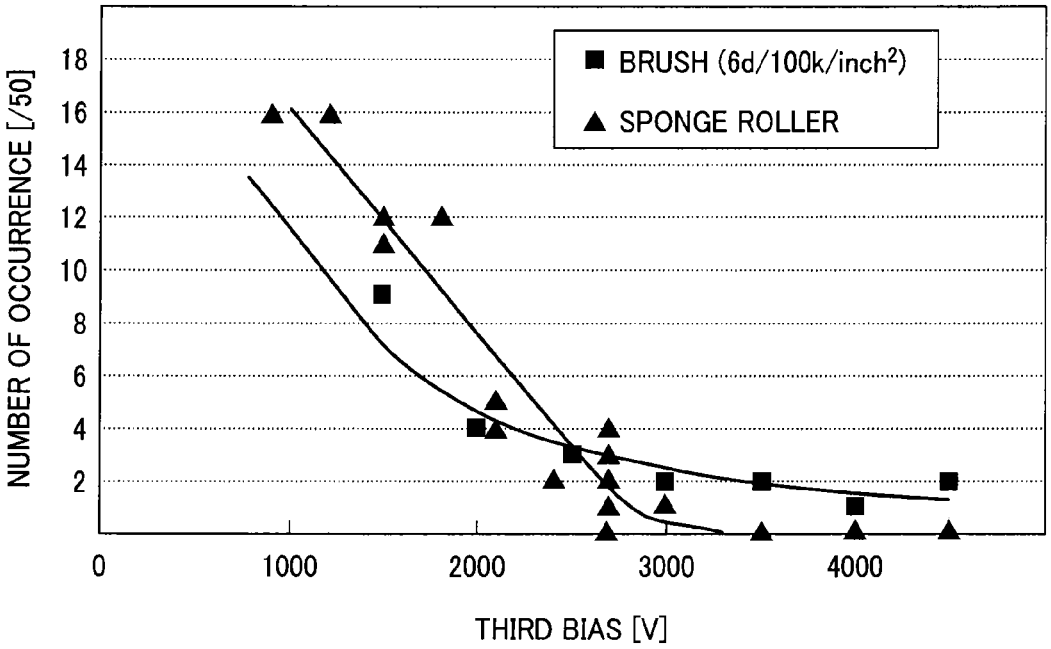
FIG. 4 is a graph of a relationship between the voltage applied to a post cleaning roller and the number of occurrence of stain-shaped abnormal image.
Figure 5:
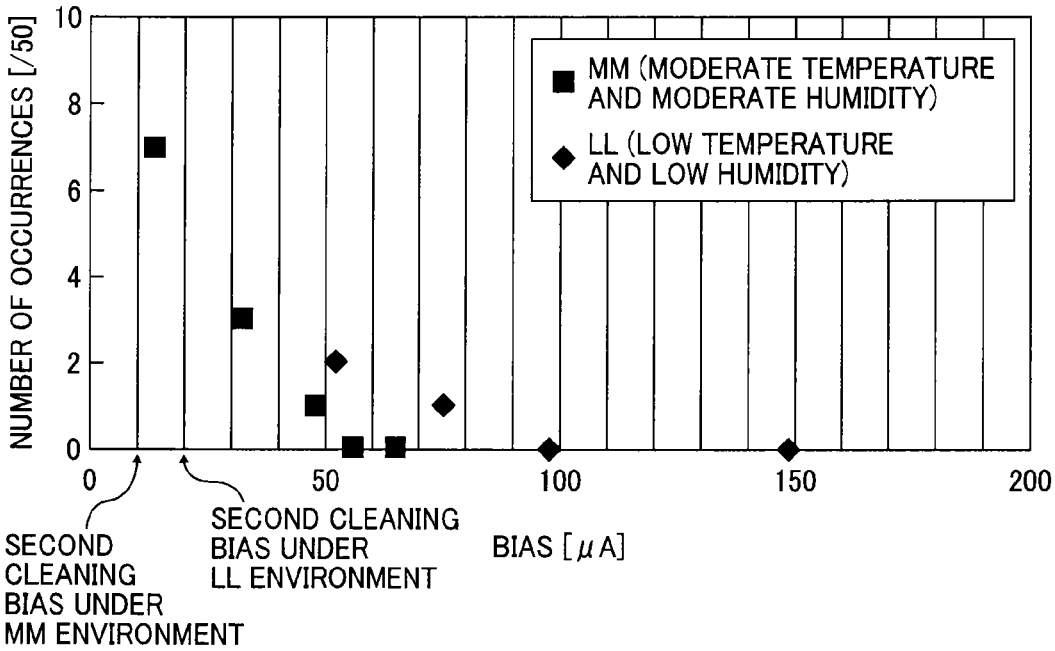
FIG. 5 is a graph of a relationship between the voltage applied to a post cleaning roller and the number of occurrence of stain-shaped abnormal image under a moderate temperature and moderate humidity environment and a low temperature and low humidity environment.

FIG. 4 is a graph of a relationship between the voltage applied to the post cleaning roller 107 and the number of recording sheets on which stain-shaped abnormal images occur. The number of occurrence in the vertical axis of FIG. 4 represents the number of recording sheets on which stain-shaped abnormal images. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image. As illustrated in FIG. 4, as the voltage applied to the post cleaning roller 107 increases, the number of occurrence of stain-shaped abnormal image decreases. In particular, in the configuration in which the post cleaning roller 107 is a conductive sponge roller, increasing the applied voltage can reduce the number of occurrence of stain-shaped abnormal image to zero. In the above-described example, the cleaning performance of the post cleaning unit 100*c* relative to re-adhesion toner and the occurrence of re-adhesion toner are evaluated based on the number of occurrence of stain-shaped abnormal image. However, the tendency of the results does not differ when evaluated by other evaluation methods.

Figure 8:
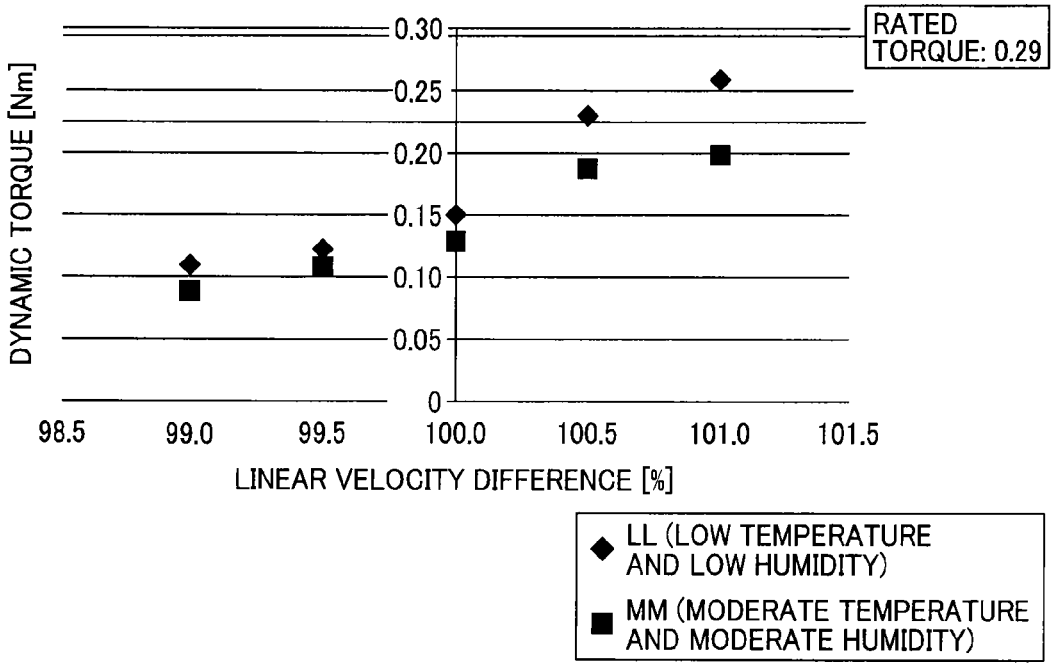
FIG. 8 is a graph of a relationship between the linear velocity difference between the post cleaning roller and the intermediate transfer belt and the torque of a drive motor to drive the belt cleaning device.

How large an applied bias is enough depends on a target user, system, and environment of the apparatus. In this embodiment, as illustrated in FIG. 8, under a low-temperature and low-humidity (LL) environment, the current setting value of the second cleaning brush roller 104 is set to 20 μA and the current setting value of the first cleaning brush roller 101 is set to −30 μA. In this case, when the current value of the post cleaning roller 107 is set to 55 μA, the number of occurrence of stain-shaped abnormal image is zero. At this time, the absolute value of the current value used for the first cleaning brush roller 101 is |30| μA while the absolute value of the current value used for the post cleaning roller 107 is |55| μA. When the current value of the post cleaning roller 107 is 1.8 times or greater than the current value of the first cleaning brush roller 101, the number of occurrence of stain-shaped abnormal image is zero. Note that the current value used herein represents a current flowing from the first cleaning brush roller 101 or the post cleaning roller 107 to the intermediate transfer belt 2.

Further, under a room-temperature (moderate-temperature) and moderate-humidity (MM) environment, the current setting value of the second cleaning brush roller 104 is set to 10 μA and the current setting value of the first cleaning brush roller 101 is set to −30 μA. At this time, when a current of 100 μA, which is 3.3 times or greater than the absolute value of the current value used for the first cleaning brush roller 101 is applied to the post cleaning roller 107, the number of occurrence of stain-shaped abnormal image is zero.

Further, in a further research on a high-humidity environment, when a current having an absolute value of 10 or 30 times or greater than the absolute value of the current value used for the first cleaning brush roller 101 is applied to the post cleaning roller 107, the number of occurrence of stain-shaped abnormal image is zero. As described above, as the humidity increases, the current value of the post cleaning roller 107 necessary to prevent an abnormal image due to re-adhesion toner becomes greater.

Thus, the absolute value of the current of the post cleaning roller 107 is set to be at least twice or greater than the absolute value of the current of each of the first cleaning brush roller 101 and the second cleaning brush roller 104. Under the respective environments, the current value of the post cleaning roller 107 is changed to be different. For example, the image forming apparatus 1 includes a temperature-and-humidity sensor to detect temperature and humidity in the image forming apparatus 1 and changes the current value of the post cleaning roller 107 in accordance with detection results of the temperature-and-humidity sensor. Note that, the voltage value applied to the post cleaning roller 107 may be changed depending on the environments.

The post cleaning roller 107 includes a metal rotation shaft rotatably supported and a conductive sponge roller portion covering the peripheral surface of the rotation shaft, and has an outer diameter ϕ of 15 mm to 16 mm. The post collection roller 108 has a configuration similar to, if not the same as, the first collection roller 102 and the second collection roller 105.

As illustrated in FIG. 4, for the first cleaning brush roller 101 and the second cleaning brush roller 104, the number of occurrence of stain-shaped abnormal image can be reduced by increasing the bias applied. However, the number of occurrence is not reduced to zero. By contrast, for the conductive sponge roller, the number of occurrence of stain-shaped abnormal image can be reduced to zero by increasing the bias applied. For the first cleaning brush roller 101 and the second cleaning brush roller 104, toner attracted to the brush may move to a bottom of the brush. Such toner having moved to the bottom of the brush may not be collected with the collection rollers and may remain in the brush. Such toner remaining in the brush is supposed to occasionally adhere to the intermediate transfer belt 2 again. Therefore, for the brush rollers, it is supposed that re-adhesion toner removed with the brush rollers adheres again to the intermediate transfer belt 2 and the number of occurrence of stain-shaped abnormal image is not reduced to zero.

By contrast, for the conductive sponge roller, toner attracted to the sponge roller remains near the surface of the sponge roller. Therefore, it is supposed that toner attracted to the sponge roller is collected well and uncollected toner remaining on the sponge roller hardly occur. As a result, toner adhered from the sponge roller to the intermediate transfer belt 2 again does not occur, and the number of occurrence of stain-shaped abnormal image is reduced to zero.

In this embodiment, a sponge roller is employed as the post cleaning roller 107. However, in some embodiments, a rubber roller or a metal roller may be employed. Even a rubber roller or a metal roller can prevents the post cleaning roller 107 from continuously holding toner. Such a configuration prevents re-adhesion toner having been removed with the post cleaning roller 107 from adhering again from the post cleaning roller 107 to the intermediate transfer belt 2, thus allowing the number of occurrence of stain-shaped abnormal image to be reduced to zero.

Alternatively, when a conductive sponge roller is employed as the cleaning member of each of the first cleaning unit 100*a* and the second cleaning unit 100*b*, the post cleaning unit 100*c* might be obviated without generating re-adhesion toner. However, if the cleaning member of each of the first cleaning unit 100*a* and the second cleaning unit 100*b* is a conductive sponge roller, post-secondary-transfer residual toner might not be excellently removed. One reason is that, for the conductive sponge roller, a cleaning nip between the intermediate transfer belt and the cleaning member is not so broad as for a brush roller. As a result, a sufficient time may not be obtained for electrostatic attraction of post-secondary-transfer residual toner from the intermediate transfer belt 2 to the cleaning members, thus hampering excellent removal of post-secondary-transfer residual toner. Accordingly, using the brush rollers as the cleaning members of the first cleaning unit 100*a* and the second cleaning unit 100*b* allows excellent removal of post-secondary-transfer residual toner. Further, re-adhesion toner adhered from the cleaning brush roller to the intermediate transfer belt 2 again is infrequent and the amount of re-adhesion toner is smaller than the amount of post-secondary-transfer residual toner. Accordingly, even if the conductive sponge roller is employed and the cleaning nip is narrower than when the brush roller is employed, re-adhesion toner is fully removed.

Figure 6:
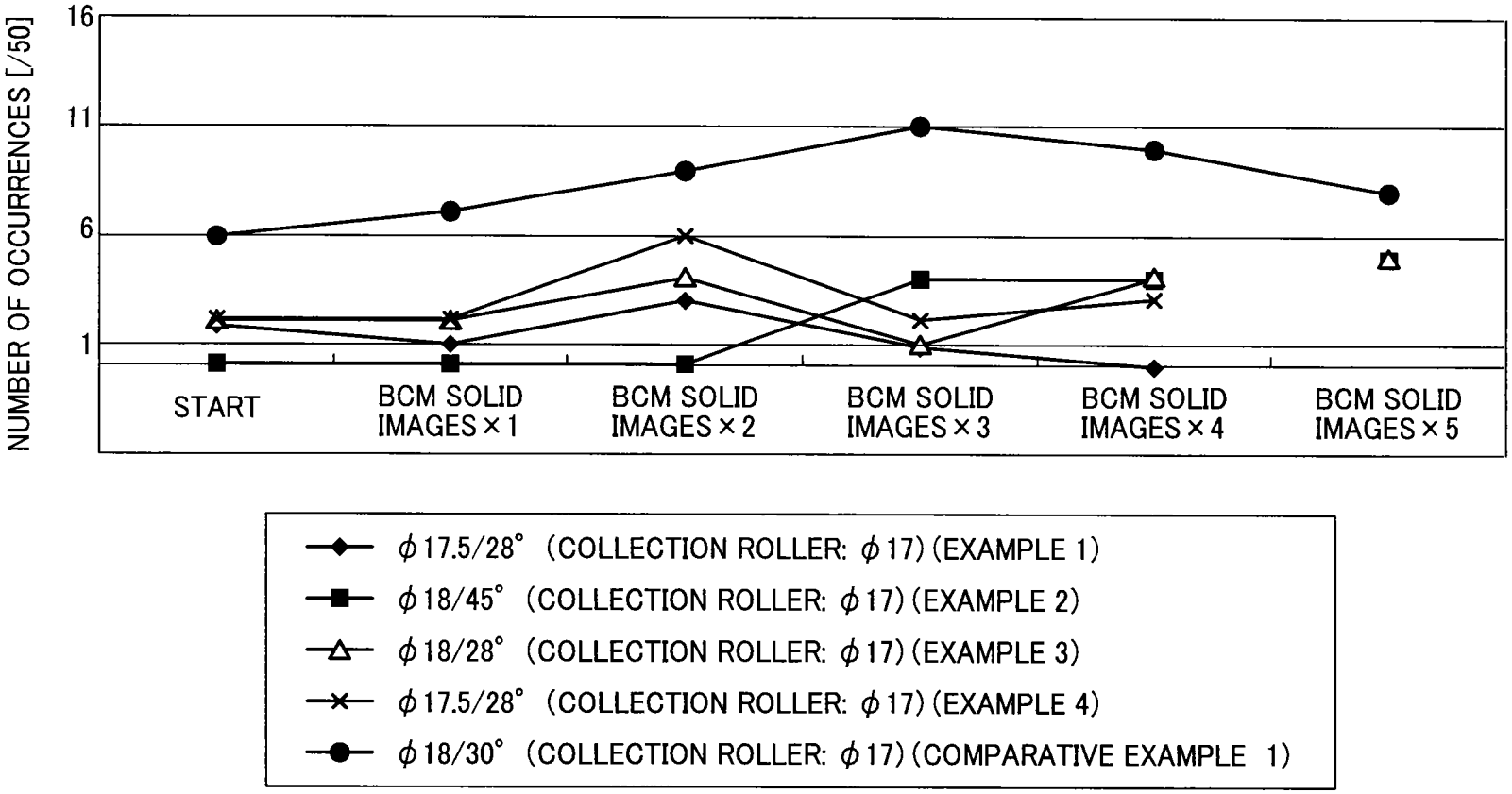
FIG. 6 is a graph of data on the number of occurrence of stain-shaped abnormal image for examples 1 through 4 and a comparative example 1.

The average cell diameter of the post cleaning roller 107 made of the conductive sponge roller is preferably 150 μm or smaller. FIG. 6 is a graph of data on the number of occurrence of stain-shaped abnormal image for examples 1 through 4 and a comparative example 1. In the examples 1 through 4, a conductive sponge roller having an average cell diameter ϕ of 150 μm or smaller is used. In the comparative example 1, a conductive sponge roller having an average cell diameter ϕ of from 386 μm to 795 μm is used. Note that, the cell diameters of the examples 1 through 4 are in a range from 99 μm to 134 μm. The number of occurrence in the vertical axis in FIG. 6 represents the number of recording sheets on which stain-shaped abnormal images are formed under a high-temperature and high-humidity (HH) environment. Continuous formation of M, C, and B-color solid images on 50 recording sheets for each color is repeated for a predetermined number of times (0 to 5 times), and then Y-color solid images are formed on 50 recording sheets. The Y-color solid images on the 50 recording sheets are visually checked for the occurrence of stain-shaped abnormal image. The term "start" in the horizontal axis represents visually checked results of Y-color solid images formed on 50 recording sheets without the continuous formation of M, C, and B-color solid images. The term "BCM solid images×1" represents visually checked results of Y-color solid images formed on 50 recording sheets after the continuous formation of M, C, and B-color solid images on 50 recording sheets for each color is performed once. The term "BCM solid images×5" represents visually checked results of Y-color solid images formed on 50 recording sheets after the continuous formation of M, C, and B-color solid images on 50 recording sheets for each color is performed five times. The examples 1 through 4 are different in the diameter and Asker C hardness of the post cleaning roller 107 and the diameters of the collection rollers.

As illustrated in FIG. 6, for the examples 1 through 4 in which the cell diameter is 150 μm or smaller, the number of occurrence of stain-shaped abnormal image is 6 sheets or smaller. By contrast, for the comparative example 1 in which the cell diameter is in a range from 386 μm to 795 μm, the number of occurrence of stain-shaped abnormal image is 6 sheets or greater. This is supposed to be due to the following two reasons. One reason is that, for the comparative example 1 of a larger cell diameter, re-adhesion toner on the intermediate transfer belt 2 passes through the post cleaning roller 107 without being attracted to the post cleaning roller 107 and, as a result, the removal performance of re-adhesion toner decreases. The second reason is that a larger cell diameter increases toner moved inside the sponge roller and such toner is not collected with the post collection roller 108 and remains in the sponge roller. Accordingly, re-adhesion toner from the post cleaning roller 107 to the intermediate transfer belt 2 increases. For the two reasons, it is supposed that the sponge roller having the larger cell diameter does not fully reduce the occurrence of stain-shaped abnormal image due to re-adhesion toner.

By contrast, for the examples 1 through 4 in which the cell diameter is 150 μm or smaller, the post cleaning roller 107 contacts re-adhesion toner on the intermediate transfer belt 2 well, thus allowing re-adhesion toner on the intermediate transfer belt 2 to be excellently attracted to the post cleaning roller 107. Such a configuration prevents the attracted toner from moving deep into cells, thus allowing excellent collection of toner with the post collection roller 108. Thus, the occurrence of stain-shaped abnormal image due to re-attracted toner is excellently reduced.

The post cleaning roller 107 made of the sponge roller is preferably rotated so that a direction of travel of the surface of the post cleaning roller 107 is the same as the belt travel direction BTD of the intermediate transfer belt 2, at a contact position at which the post cleaning roller 107 contacts the intermediate transfer belt 2. Hereinafter, the direction of rotation of the post cleaning roller 107 is referred to as forward rotation. The sponge roller is greater in rotation load than the brush roller. Accordingly, like the first cleaning brush roller 101 and the second cleaning brush roller 104, when the post cleaning roller 107 made of the sponge roller is rotated in a direction opposite to the belt travel direction BTD of the intermediate transfer belt 2 (hereinafter, reverse rotation) at the contact position with the intermediate transfer belt 2, for example, the following failure may occur. In other words, it may be necessary to use an expensive drive motor of a large rated torque, such as an intermediate transfer drive motor to drive the intermediate transfer belt 2 or a cleaning derive motor to drive, e.g., the post cleaning roller 107, thus resulting in an increase in cost of the apparatus. Further, the cleaning performance does not differ between the forward rotation and the reverse rotation of the post cleaning roller 107. In any of the forward rotation and the reverse rotation, re-adhesion toner does not move to the image forming unit 66 and no stain-shaped abnormal image occurs. For these reasons, the forward rotation of the post cleaning roller 107 is preferable.

Figure 7:
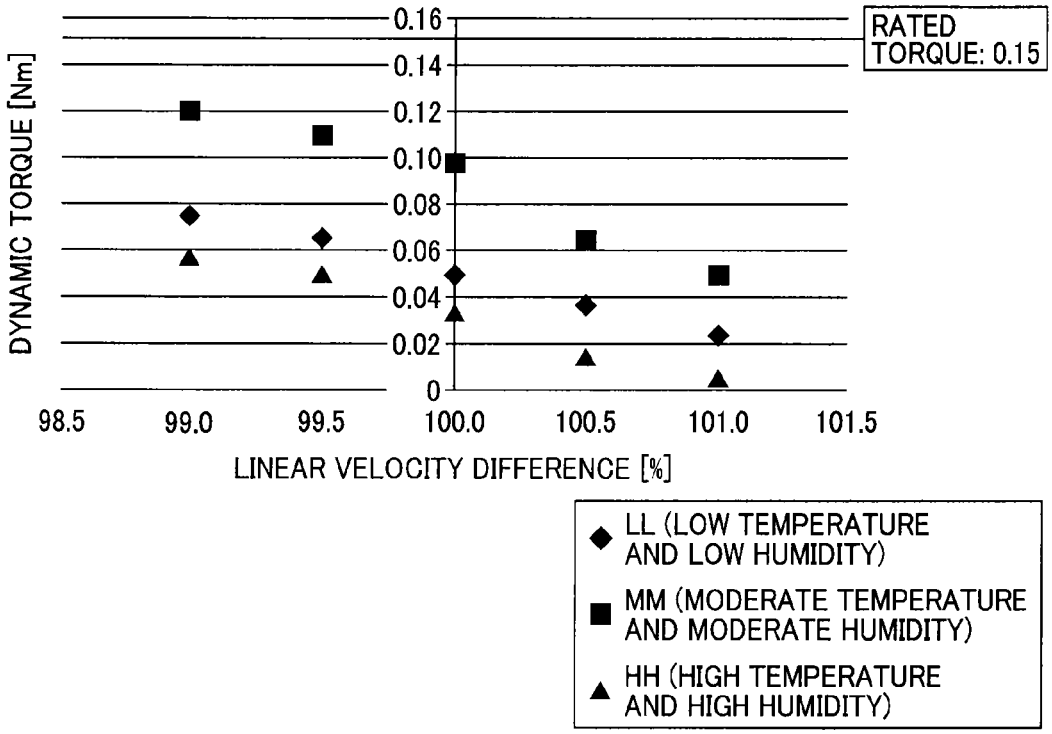
FIG. 7 is a graph of a relationship between the linear velocity difference between the post cleaning roller and the intermediate transfer belt and the torque of an intermediate drive motor to drive the intermediate transfer belt.

FIG. 7 is a graph of a relationship between the linear velocity difference between the post cleaning roller 107 and the intermediate transfer belt 2 and the torque of an intermediate drive motor to drive the intermediate transfer belt 2. FIG. 8 is a graph of a relationship between the linear velocity difference between the post cleaning roller 107 and the intermediate transfer belt 2, each of the collection rollers of the belt cleaning device 10, the torque of a cleaning drive motor to drive each of the cleaning rollers. The linear velocity difference in FIGS. 7 and 8 is represented by (the linear velocity of the post cleaning roller 107/the linear velocity of the intermediate transfer belt 2)×100. The post cleaning roller 107 is rotated forward.

As illustrated in FIG. 7, when the linear velocity of the post cleaning roller 107 is slower than the linear velocity of the intermediate transfer belt 2 by more than 1%, under the room-temperature and moderate-humidity (MM) environment, the torque of the intermediate drive motor rises near the rated torque. As illustrated in FIG. 8, when the linear velocity of the post cleaning roller 107 is faster than the linear velocity of the intermediate transfer belt 2 by more than 1%, under the low-temperature and low-humidity (LL) environment, the torque of the cleaning drive motor rises near the rated torque.

As seen from FIGS. 7 and 8, the linear velocity of the post cleaning roller 107 is preferably within a range of ±1% of the linear velocity difference being 100%. For example, a configuration in which the post cleaning roller 107 is rotated with rotation of the intermediate transfer belt 2 obviates a drive transmission assembly to drive and rotate the post cleaning roller 107. Such a configuration preferably reduce the number of components and the cost of the apparatus. By contrast, a configuration in which the post cleaning roller 107 is driven and rotated with the cleaning drive motor is advantageous in more stably rotating the post cleaning roller 107 than the configuration in which the post cleaning roller 107 is rotated with rotation of the intermediate transfer belt 2.

Figure 9:
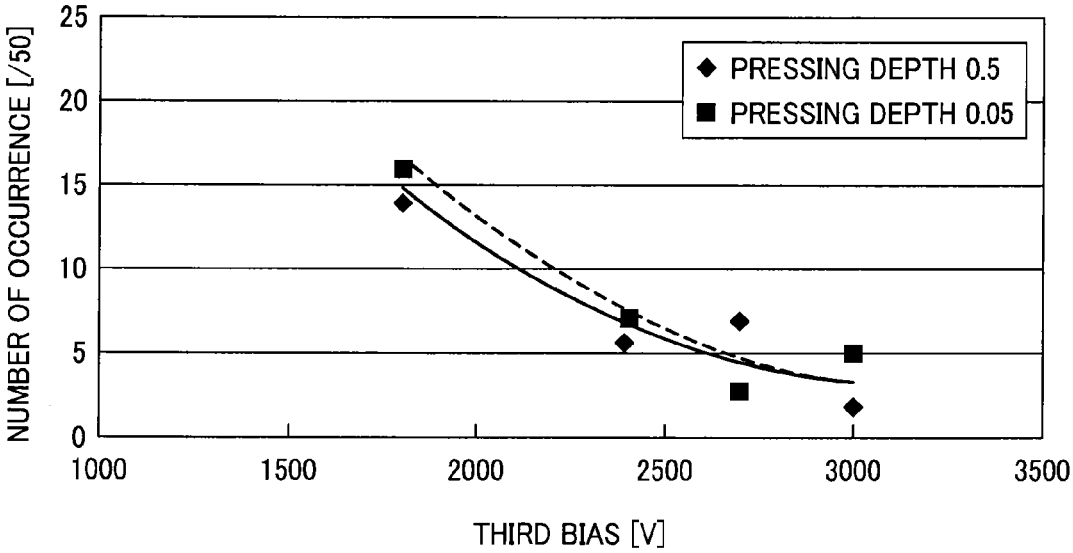
FIG. 9 is a graph of a relationship between the depth at which the post cleaning roller presses the intermediate transfer belt and the number of occurrence of stain-shaped abnormal image.

FIG. 9 is a graph of a relationship between the depth at which the post cleaning roller 107 presses against the intermediate transfer belt 2 and the number of occurrence of stain-shaped abnormal image. The number of occurrence of stain-shaped abnormal image represents the number of recording sheets on which stain-shaped abnormal images are formed under a high-temperature and high-humidity environment. M, C, and B-color solid images are continuously formed on 50 recording sheets for each color, and then Y-color solid images are formed on 50 recording sheets. The Y-color solid images on the 50 recording sheets are visually checked for the occurrence of stain-shaped abnormal image. As seen from FIG. 9, considering variations of data, there is no difference between the depth of 0.5 mm and the depth of 0.05 mm in the relationship of the applied bias and the number of occurrence of stain-shaped abnormal image. In a viewpoint of drive load, the depth is preferably smaller. However, considering variations of the depth, the desirable range is from 0.05 mm to 0.35 mm for actual use. Since the torque is adjustable by increasing the motor rating, at least the depths from 0.05 mm to 0.5 mm are usable without causing much difference from a viewpoint of the prevention of occurrence of stain-shaped abnormal image.

The inventors of the present application has researched the number of occurrence of stain-shaped abnormal image in a similar manner to the above-described manner, using a sponge roller having an Asker C hardness of 28 degrees and a sponge roller having an Asker C hardness of 45 degrees. As a result, the number of occurrence of stain-shaped abnormal image does not differ between 28 degrees and 45 degrees of the Asker C hardness. The post cleaning roller 107 is preferably soft from the viewpoints of drive load and the setting property at which the post cleaning roller 107 is set against the post collection roller 108 while compressing the post collection roller 108. From the viewpoint of the prevention of occurrence of stain-shaped abnormal image due to re-adhesion toner, at least Asker C hardnesses from 28 degrees to 45 degrees are usable without causing much difference. For example, in this embodiment, the Asker C hardness of the post cleaning roller 107 is set to 35 degrees. Setting the Asker C hardness to 35 degrees allows the Asker C hardness of the post cleaning roller 107 to be in a range of not less than 28 degrees and not greater than 45 degrees even if mass-production variations are included.

Like the first collection roller 102 and the second collection roller 105, the post collection roller 108 is a stainless steel (SUS) roller and has a configuration similar to, if not the same as, each of the first collection roller 102 and the second collection roller 105.

As described above, re-adhesion toner adhered from the second cleaning brush roller 104 to the intermediate transfer belt 2 again and a slight amount of toner of the negative polarity having not been removed with the second cleaning brush roller 104 is transferred to the post cleaning roller 107. Such re-adhesion toner and a slight amount of toner of the negative polarity transferred to the post cleaning roller 107 are electrostatically attracted to the post cleaning roller 107 applied with a voltage of the opposite polarity of the normal charge polarity of toner. The re-adhesion toner and the slight amount of toner of the negative polarity are collected with the post collection roller 108 and scraped off from the post collection roller 108 with the post scraping blade 109. Such toner scraped from the post collection roller 108 with the post scraping blade 109 is transported from the post cleaning unit 100*c* to the toner storage portion with the post transport screw 110*c*.

Conditions of each of the first cleaning brush roller 101 and the second cleaning brush roller 104 are as follows.

- Material of brush: conductive polyester (A first brush has a structure including a conductive material on a surface of each fiber and a second brush has a core-sheath structure in which the interior of each fiber is made of conductive carbon and the surface of each fiber is made of polyester, and both are available from a brush manufacturer, e.g., TOEISANGYO CO LTD.)
- Resistance of brush: $10^6\Omega$ to $10^8\Omega$
- Planting density of brush fibers: sixty thousand to one hundred fifty thousand per square inch
- Diameter of brush fiber: about 25 μm to about 35 μm
- Flattening of brush edges: None
- Brush diameter ϕ: 14 mm to 20 mm
- Depth of brush fibers pressed into the intermediate transfer belt 2: 1 mm to 1.5 mm Conditions of the post cleaning roller 107 are as follows:

- Material of cleaning roller: conductive polyurethane (manufactured by Yamauchi Corporation)
- Diameter ϕ: 14 mm to 20 mm
- Resistance: $10^{7.25\pm0.25}\Omega$
- Hardness: Asker C hardness of 35 degrees
- Depth of the post cleaning roller 107 pressed into the intermediate transfer belt 2: 0.05 mm to 0.4 mm The voltage applied to the first cleaning brush roller 101 is set so that, when post-secondary-transfer residual toner is input to the intermediate transfer belt 2, toner charged with the opposite polarity does not occur. For example, the voltage applied to the first cleaning brush roller 101 is determined through an experiment in which, after passing the first cleaning brush roller 101, toner may be sucked by air and measured in, e.g., a Faraday cage or through a research about toner adhesion after cleaning.

The second cleaning brush roller 104 is set to remove toner on the intermediate transfer belt 2. The planting density of brush fibers, the resistance of brush, the fiber diameter, the voltage applied, the fiber type, and the depth at which brush fibers press into the intermediate transfer belt 2 can be optimized according to a system used, and are not limited to the above-described types and values. Examples of the fiber type usable include nylon, acryl, polyester, and so on.

Conditions of each of the first collection roller 102, the second collection roller 105, and the post collection roller 108 are as follows:

Material of metal core of collection roller: SUS 303

Depth of brush fibers pressed into collection roller: 1 mm to 1.5 mm

Pressing depth of collection roller: 0.5 mm

Material of the collection rollers, the depth of brush fibers pressing into each collection roller, the voltage applied can be optimized for a system used, and are not limited to the above-described material and values.

Conditions of the first scraping blade 103, the second scraping blade 106, and the third scraping blade 109 are as follows:

Material of scraping blade: SUS 304

Contact angle of blade: 20°

Thickness of blade: 0.1 mm

Depth of blade pressed into collection roller: 0.5 mm to 1.5 mm

The contact angle of blade, the thickness of blade, and the depth of blade pressed into each collection roller can be optimized for a system used, and are not limited to the above-described values.

Note that the cleaning current to obtain a best cleaning performance is a target current flowing a contact point between the intermediate transfer belt 2 and each of the first cleaning brush roller 101, the second cleaning brush roller 104, and the post cleaning roller 107. Table 1 is a table of an example of target current values. The term "1st" represents the first cleaning brush roller 101, the term "2nd" represents the second cleaning brush roller 104, and the term "3rd" represents the post cleaning roller 107. In this embodiment, the first cleaning brush roller 101 is set to a constant voltage. This is because of a reason of current control, and indeed, current setting is preferable. The values enclosed in the parentheses are reference values.

TABLE 1

| | | 1st | 2nd | 3rd |
|---|---|---|---|---|
| LL | Voltage | −2100 | (2100) | (5700) |
| | Current | (−30) | 20 | 55 |
| MM | Voltage | −2000 | (1400) | (4200) |
| | Current | (−30) | 10 | 110 |
| HH | Voltage | −1500 | (800) | (3000) |
| | Current | (−30) | 10 | 270 |

Note:
The unit of voltage is V and the unit of current is μA

The process linear velocity in this embodiment is set to 350 mm/s. Note that process linear velocities of from 100 mm/s to 800 mm/s are compatible.

The target current is set to a value proportional to the linear velocity. For example, when the process linear velocity is 175 mm/s which is half of 350 mm/s, the target current value is set to half of the target current value for the process linear velocity of 350 mm/s. Alternatively, when the process linear velocity is 700 mm/s which is twice as fast as 350 mm/s, the target current value is set to twice as large as the target current value for the process linear velocity of 350 mm/s.

The planting density of brush fibers of the second cleaning brush roller 104 is preferably set to lower than the planting density of brush fibers of the first cleaning brush roller 101, for example, in a range of from fifteen thousand per square inch to twenty thousand per square inch.

Table 2 is a table of experiment results of different planting densities of brush fibers and thicknesses of the second cleaning brush roller 104.

TABLE 2

| Planting density of brush | Thickness of brush | Frequency of occurrence of stain-shaped image |
|---|---|---|
| One hundred thousand per square inch | 6 denier | 49 sheets/50 sheets |
| Twenty thousand per square inch | 14 denier | 3 sheets/50 sheets |

The frequency of occurrence of stain-shaped abnormal image of Table 2 represents the number of recording sheets on which stain-shaped abnormal images are formed under a high-temperature and high-humidity environment in which a stain-shaped abnormal image is likely to occur. Continuous formation of M, C, and B-color solid images on 50 recording sheets for each color is repeated three times, and then Y-color solid images are formed on 50 recording sheets. The Y-color solid images on the 50 recording sheets are visually checked for the occurrence of stain-shaped abnormal image. The first cleaning brush roller 101 is applied with −1400 V. The second cleaning brush roller 104 is applied with 1200 V. The post cleaning roller 107 is applied with 2500 V.

As illustrated in Table 2, it is found that setting the planting density of brush fibers of the second cleaning brush roller 104 to be lower than the planting density of brush fibers of the first cleaning brush roller 101 reduces the number of occurrence of stain-shaped abnormal image due to re-adhesion toner. This is supposed to be because reducing the planting density reduces the number of raising fibers and the amount of toner caught into the brush and, as a result, the amount of re-adhesion toner adhered from the second cleaning brush roller 104 to the intermediate transfer belt 2 again is reduced. In similar experiments with different experiment environments, when a brush of 14 denier and twenty thousand per square inch is used as the second cleaning brush roller 104, the occurrence of stain-shaped abnormal image is prevented.

The brush fibers are preferably as thick as possible so that the brush contacts the intermediate transfer belt 2 with less clearances at the contact position. By contacting the intermediate transfer belt 2 with less clearances at the contact position, post-secondary-transfer residual toner on the intermediate transfer belt 2 reliably contacts the brush, thus allowing excellent removal of post-secondary-transfer residual toner.

Next, this embodiment is further described below. Note that the post cleaning unit 100*c* is further described below, and each of the first cleaning unit 100*a* and the second cleaning unit 100*b* has a configuration similar to the configuration of the post cleaning unit 100*c*.

Figure 10:
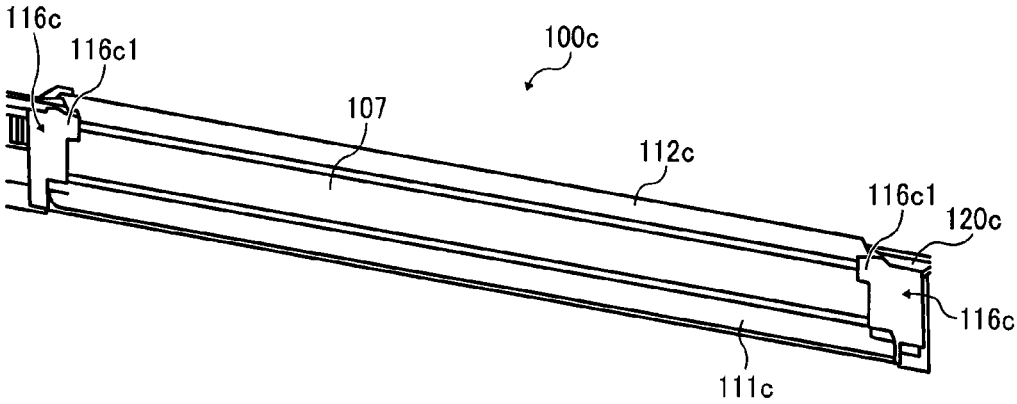
FIG. 10 is a perspective view of a post cleaning unit seen from an opposite portion opposite the intermediate transfer belt.

FIG. 10 is a perspective view of the post cleaning unit 100*c* seen from a side of the intermediate transfer belt 2. As illustrated in FIG. 10, the entry seal 111*c*, the exit seal 112*c*, and a side seal 116*c* are disposed around an opening of the post casing 120*c* to expose the post cleaning roller 107 to the outside. Each seal contacts the intermediate transfer belt 2 to seal a gap between the post casing 120*c* and the intermediate transfer belt 2, thus reducing toner scattered from the opening of the post casing 120*c*.

A contact pressure and a contact angle of each of the entry seal 111*c* and the exit seal 112*c* relative to the intermediate transfer belt 2 are set so that the entry seal 111*c* and the exit seal 112*c* do not block toner on the intermediate transfer belt 2. If the entry seal 111*c* blocks toner on the intermediate transfer belt 2, blocked toner might scatter and stain the image forming apparatus. Further, if the exit seal 112*c* blocks toner on the intermediate transfer belt 2, the following failure might occur. For example, if toner is blocked with the exit seal 112*c*, toner would accumulate on the exit seal 112*c* over time. As a result, a fee end of the exit seal 112*c* is separated from the intermediate transfer belt 2 by a pressure of accumulated toner, and a large amount of accumulated toner rapidly moves to an area downstream from the exit seal 112*c*. For the post cleaning unit 100*c*, such a large amount of toner having moved to the area downstream from the exit seal 112*c* might cause an outstanding image failure. Alternatively, for the first cleaning unit 100*a* or the second cleaning unit 100*b*, such a large amount of toner would not be removed with a cleaning unit downstream from the first cleaning unit 100*a* or the second cleaning unit 100*b*, thus causing an image failure.

For the post cleaning unit 100*c*, toner input to the exit seal 112*c* is a slight amount of toner having not been removed with the first cleaning unit 100*a* and the second cleaning unit 100*b*. Accordingly, even if the exit seal 112*c* does not block toner, only a slight amount of toner passes the exit seal 112*c*. Therefore, the influence of such toner to a resultant image is quite slight and negligible. For the first cleaning unit 100*a* and the second cleaning unit 100*b*, toner having passed the exit seal is excellently removed with a cleaning unit downstream(s) from the first cleaning unit 100*a* and the second cleaning unit 100*b*. Accordingly, the exit seal is disposed not to block toner on the intermediate transfer belt 2.

Each of the entry seal 111*c* and the exit seal 112*c* is an urethane seal having a rectangular shape longer in an axial direction and a thickness of not less than 0.20 mm and not greater than 0.30 mm. If the thickness is less than 0.20 mm, the hardness would be lack. For example, an air flow generated by the rotation of the post cleaning roller 107 might float and separate the free end from the intermediate transfer belt 2, thus scattering toner from the casing. By contrast, if the thickness is greater than 0.3 mm, the hardness would be relatively high. The contact pressure of the entry seal 111*c* or the exit seal 112*c* with the intermediate transfer belt 2 might increase and block toner on the intermediate transfer belt 2. As illustrated in FIG. 3, each of the entry seal 111*c* and the exit seal 112*c* are attached to the post casing 120*c* with, e.g., double-sided adhesive tapes so as to contact the intermediate transfer belt 2 from a trailing direction of each of the entry seal 111*c* and the exit seal 112*c*.

Each of the entry seal 111*c* and the exit seal 112*c* contacts the intermediate transfer belt 2 at a predetermined depth so as to be bent. As described above, the length from the free end to the attached end of each of the entry seal 111*c* and the exit seal 112*c* is set to be a predetermined length such that each seal is excellently bent when the seal contacts the intermediate transfer belt 2 at the predetermined depth.

Each of the exit seal 112*c* and the entry seal 111*c* contacts the intermediate transfer belt 2 at an angle so as not to block toner on the intermediate transfer belt 2. In this embodiment, the contact angle of each of the exit seal 112*c* and the entry seal 111*c* with the intermediate transfer belt 2 is set to be 23.1°. The contact angle is an angle formed by the outer surface of the intermediate transfer belt 2 and an opposite face of each seal opposite the intermediate transfer belt 2 in an assumed straight state of each seal in which each seal, which is bent by contacting the intermediate transfer belt 2 at the predetermined depth, is extended straight.

Figure 11:
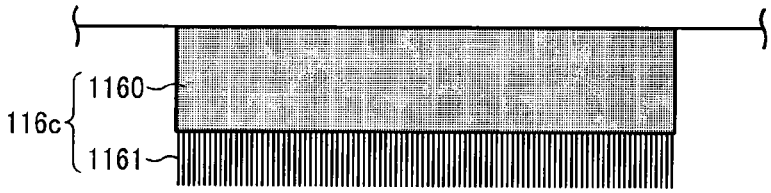
FIG. 11 is a schematic cross-sectional view of a side seal.

As illustrated in FIG. 11, the side seal 116*c* at each axial end of the post casing 120*c* includes an elastic layer 1160 made of, e.g., sponge and a seal layer 1161 made of soft bristle brush. The side seal 116*c* is attached to the post casing 120*c* with, e.g., a double-sided adhesive tape. By elastically deforming the elastic layer 1160, the side seal 116*c* contacts the intermediate transfer belt 2. As described above, by contacting the side seal 116*c* with the intermediate transfer belt 2 by elastically deforming the elastic layer 1160, the side seal 116*c* excellently follows the outer surface of the intermediate transfer belt 2, thus obtaining a good sealing performance. The elastic layer 1160 prevents a rise of the contact pressure of the side seal 116*c* with the intermediate transfer belt 2, thus reducing the drive load to the intermediate transfer belt 2.

A portion of an entry side of the side seal 116*c* is disposed to overlap with a free end side of each lateral end of the entry seal 111*c* in a vertical direction relative to the surface of the intermediate transfer belt 2. At an exit side of the side seal 116*c*, an overlap portion 116*c*1 is disposed protruding toward an axial center of the side seal 116*c*.

Figure 12:
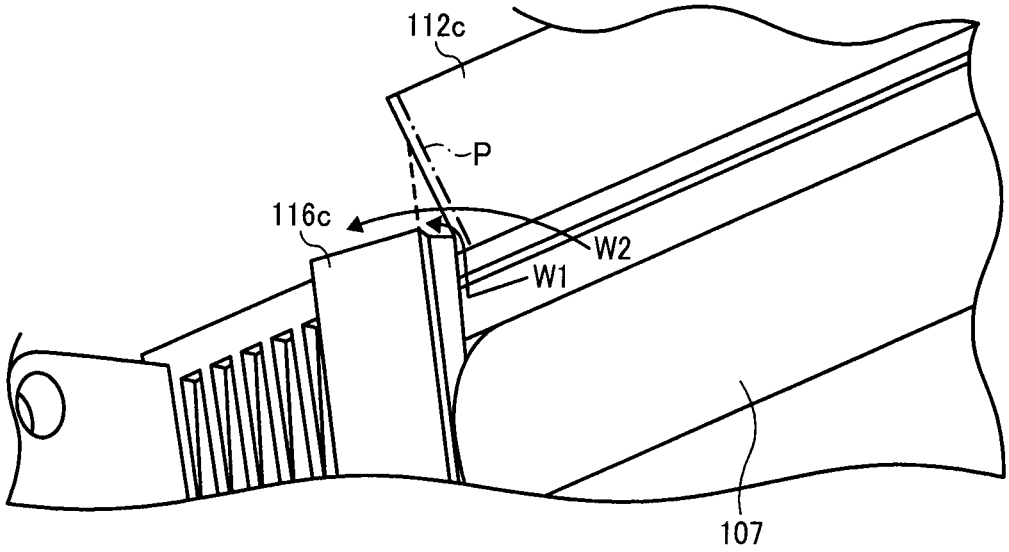
FIG. 12 is a perspective view of an exit side of an axial end of a comparative example of a cleaning unit.

FIG. 12 is a perspective view of an axial end at an exit side of a comparative example of a cleaning unit. To contact the exit seal 112*c* with the intermediate transfer belt 2 from the trailing direction, the free end side of the exit seal 112*c* contacting the intermediate transfer belt 2 is disposed downstream from an exit-side end of the casing 120*c* in the direction of movement of the outer surface of the intermediate transfer belt 2. By contrast, as illustrated in FIG. 12, the side seal 116*c* is disposed up to the exit-side end of the casing 120*c*. Accordingly, the gap between the surface of the intermediate transfer belt 2 and the opposite face of the exit seal 112*c* opposite the intermediate transfer belt 2 may be an opening communicated with an outside of the cleaning unit at each lateral end of the exit seal 112*c*. If the opening is slight, little toner scatters from the opening. However, to obtain a good bend and prevent a rise in the contact pressure when the exit seal 112*c* contacts the intermediate transfer belt 2 at the predetermined depth, the exit seal 112*c* preferably has a certain length from the free end to the attached end. Further, the exit seal 112*c* is contacted against the intermediate transfer belt 2 at a predetermined contact angle (e.g., 23.1° in this embodiment) so as not to block toner on the intermediate transfer belt 2. As described above, when an exit seal having a certain length is attached at a contact angle so as not to block toner, the attached end of the exit seal 112*c* is secured at a position away from the surface of the intermediate transfer belt 2 to some extent. In this embodiment, as illustrated in FIG. 12, the attached end of the exit seal 112*c* is secured to the post casing 120*c* at a position further away from the surface of the intermediate transfer belt 2 than the position at which the side seal 116*c* is attached. As a result, in the gap between the surface of the intermediate transfer belt 2 and the opposite face of the exit seal 112*c* opposite the intermediate transfer belt 2, an attached-end side of the opening communicated with the outside at the lateral end of the exit seal 112*c* is relatively large. Accordingly, toner might scatter from the large opening as indicated by arrows W1 and W2 of FIG. 12.

Figure 13:
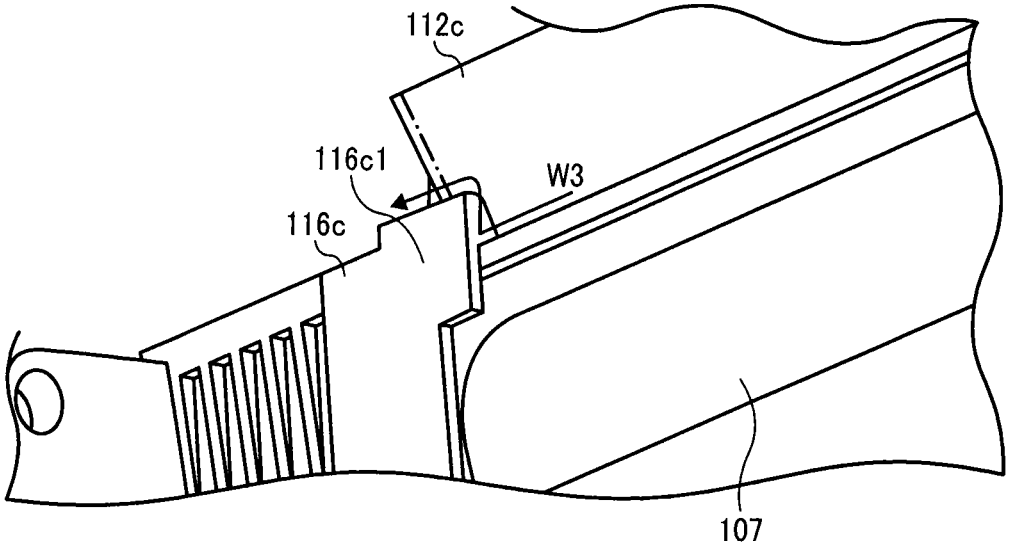
FIG. 13 is a perspective view of an exit side of an axial end of a cleaning unit according to an embodiment of the present disclosure.

Hence, in this embodiment, as illustrated in FIG. 13, the overlap portion 116*c*1 as a gap fill portion is disposed at the exit side of the side seal 116*c* to fill a gap between the surface of the intermediate transfer belt 2 and a lateral end side of the opposite face of the exit seal 112*c* opposite the intermediate transfer belt 2. Such a configuration blocks the attached-end side of the opening communicated with the outside at the lateral end of the exit seal 112*c*, in the gap between the surface of the intermediate transfer belt 2 and the opposite face of the exit seal 112*c* opposite the intermediate transfer belt 2, thus preventing toner from being scattered from the attached-end side of the opening.

In this embodiment, only the attached-end side of the opening is sealed with the overlap portion 116*c*1. However, in some embodiments, the entire opening may be sealed with the overlap portion 116*c*1. However, if the gap at the lateral end side between the surface of the intermediate transfer belt 2 and the opposite face of the exit seal 112*c* opposite the intermediate transfer belt 2 is entirely filled, the free end of the exit seal 112*c* may float from the intermediate transfer belt 2 due to a tolerance of the thickness of the overlap portion 116*c*1. As a result, toner may be scattered from a gap between the free end of the exit seal 112*c* and the intermediate transfer belt 2. By contrast, the configuration in which the overlap portion 116*c*1 is disposed at only the attached-end side of the exit seal 112*c* to fill the gap only at the attached-end side prevents the free end of the exit seal 112*c* from floating from the intermediate transfer belt 2. Since the free end side of the opening is relatively narrow, little toner is scattered from such a narrow opening. Accordingly, sealing the opening at the attached-end side of the exit seal 112*c* excellently reduces scattering of toner.

Further, the overlap portion 116*c* fills the gap between the surface of the intermediate transfer belt 2 and the lateral end side of the opposite face of the exit seal 112*c* opposite the intermediate transfer belt 2, thus further reducing toner from being scattered from the free end side of the opening. If toner is scattered from the free end side of the opening, floating toner in the casing would pass a route illustrated in arrow W3 in FIG. 13. In other words, the overlap portion 116*c*1 regulates movement of floating toner in a lateral direction between the intermediate transfer belt 2 and the attached-end side of the exit seal 112*c* having a larger gap, and floating toner moves into a slight gap between the intermediate transfer belt 2 and the free end side of the exit seal 112*c*. Such floating toner passes the slight gap in the lateral direction and is scattered from the portion of the opening at the free end side of the exit seal 112*c*. However, indeed, little toner is scattered from such a slight gap.

As illustrated in FIG. 13, the overlap portion 116*c*1 is disposed in an area from an exit of a contact portion between the post cleaning roller 107 and the intermediate transfer belt 2 to the attached end of the exit seal 112*c* in the direction of movement of the surface of the intermediate transfer belt 2.

The depth of the exit seal 112*c* to the intermediate transfer belt 2 may be not less than the depth of the entry seal 111*c* to the intermediate transfer belt 2. Such a configuration allows an increase in the distance at which the free end side of the exit seal 112*c* contacts the intermediate transfer belt 2, thus preventing the free end of the exit seal 112*c* from floating from the intermediate transfer belt 2. Alternatively, the depth of the exit seal 112*c* to the intermediate transfer belt 2 may be the same as the depth of the entry seal 111*c* to the intermediate transfer belt 2. The contact angle of the exit seal 112*c* relative to the intermediate transfer belt 2 may be the same as the contact angle of the entry seal 111*c* relative to the intermediate transfer belt 2. Such a case is advantageous in that, for example, a common seal is usable for the entry seal 111*c* and the exit seal 112*c*.

For the comparative example illustrated in FIG. 12, due to, e.g., a tolerance or an attachment error of the exit seal 112*c*, the lateral end of the exit seal 112*c* may be attached to the casing at a position indicated by broken line P in FIG. 12. In such a case, a lateral gap might arise between a lateral end face of the exit seal 112*c* and an opposite member facing the lateral end face (in other words, a side face of the side seal 116*c* or an opposite face of the post casing 120*c* opposite the lateral end face of the exit seal 112*c*). As a result, toner might be scattered from gap along the direction of movement of the intermediate transfer belt 2.

However, for this embodiment, the filler to fill the gap between the lateral end of the exit seal 112*c* and the intermediate transfer belt 2 is the overlap portion 116*c*1 extending from the side seal 116*c* toward the center in the lateral direction, thus sealing the gap in the lateral direction between the lateral end face of the exit seal 112*c* and the opposite member facing the lateral end face. Such a configuration prevents toner from being scattered from the lateral gap along the direction of movement of the surface of the intermediate transfer belt 2. The configuration in which the filler to fill the gap between the lateral end of the exit seal 112*c* and the intermediate transfer belt 2 is the overlap portion 116*c*1 extending from the side seal 116*c* toward the axial center can reduce the number of components than a configuration in which the side seal and the filler are separately provided. Accordingly, the number of steps in assembly of the cleaning unit can be reduced, thus reducing the manufacturing cost.

Like the configuration of the side seal 116*c*, the overlap portion 116*c*1 also includes an elastic layer of sponge and a seal layer. The overlap portion 116*c*1 having the elastic layer excellently fills a gap between an attached end side of each lateral end of the exit seal 112*c* and the intermediate transfer belt 2.

Further, as illustrated in FIG. 10, a portion of the side seal 116*c* at the entry side is disposed to overlap with the free end side of the lateral end of the entry seal 111*c* in the vertical direction relative to the surface of the intermediate transfer belt 2. Such a configuration seals, with the side seal 116*c*, a lateral gap between the lateral end face of the entry seal 111*c* and one of the side seal 116*c* and the side face of the post casing 120*c*, thus preventing toner from being scattered from the lateral gap between the lateral end of the entry seal 111*c* and one of the side seal 116*c* and the side face of the post casing 120*c*.

For this embodiment, as illustrated in FIG. 3, the free end of the exit seal 112*a* of the first cleaning unit 100*a* is disposed between the entry seal 111*b* of the second cleaning unit 100*b* and the intermediate transfer belt 2, and the entry seal 111*b* and the exit seal 112*c* overlap with each other in the vertical direction relative to the surface of the intermediate transfer belt 2. As described above, the first cleaning unit 100*a* and the second cleaning unit 100*b* are sealed, thus preventing scattered toner from entering between the first cleaning unit 100*a* and the second cleaning unit 100*b*. Such a configuration prevents toner from staining between the first cleaning unit 100*a* and the second cleaning unit 100*b*.

Likewise, the exit seal 112*b* of the second cleaning unit 100*b* and the entry seal 111*c* of the post cleaning unit 100*c* overlap with each other in the vertical direction relative to the surface of the intermediate transfer belt 2. Such a configuration also prevents toner from staining between the second cleaning unit 100*b* and the post cleaning unit 100*c*.

The above descriptions are limited examples and, for example, the following aspects have effects as described below.

Aspect 1

According to Aspect 1, a cleaning device includes a cleaner, such as the post cleaning roller 107, to remove toner on a cleaning target, such as the intermediate transfer belt 2, a casing accommodating the cleaner, an exit seal, such as the exit seal 112*c*, mounted to the casing and having a free end contacting the cleaning target at a position downstream from the cleaner in a direction of movement of the cleaning target. The exit seal, such as the exit seal 112*c*, contacts the cleaning target from a trailing direction of the exit seal. A gap is disposed between an opposite face of the exit seal opposite the cleaning target and the surface of the cleaning target. The gap includes an opening at a lateral end of the exit seal. The exit seal seals the opening at at least an attached end side of the exit seal. Through diligent researches, the inventors of the present application have found the following about a reason that toner is scattered from the casing to an exit side of the cleaning device when the exit seal, such as the exit seal 112*c*, is configured to contact the cleaning target, such as the intermediate transfer belt 2, from the trailing direction. In the configuration in which the exit seal, such as the exit seal 112*c*, is configured to contact the cleaning target from the trailing direction, the free end of the exit seal contacting the cleaning target is disposed downstream from an exit side of the casing in the direction of movement of the surface of the cleaning target. By contrast, the side seal 116*c* is disposed up to an exit end of the casing. As a result, a space between the surface of the cleaning target and the opposite face of the exit seal, such as the exit seal 112*c*, opposite the cleaning target includes an opening at each lateral end of the exit seal, and the space is communicated with an outside via the opening. If the opening is slight, little toner would not leak from the casing through the opening. However, for the following reason, the opening would be relatively large in design, thus causing toner to be scattered from the opening. In other words, when a slight amount of toner having not removed with the cleaner, such as the post cleaning roller 107, is blocked with the exit seal, such as the exit seal 112*c*, toner would accumulate between the exit seal and the cleaning target over time. Then, a fee end of the exit seal is separated from the cleaning target by a pressure of accumulated toner, and a large amount of accumulated toner rapidly moves to an area downstream from the exit seal. As a result, an outstanding image failure may occur. By contrast, when toner having not removed with the cleaner is not blocked with the exit seal, such as the exit seal 112*c*, and passes the exit seal, only a slight amount of toner exits from the cleaning device and the influence of such a slight amount of toner to a resultant image is at a negligible level. To not block toner with the exit seal as described above, the contact pressure at which the exit seal, such as the exit seal 112*c*, contacts the cleaning target is set to be not greater than a predetermined value and the exit seal is configured to contact the cleaning target at a predetermined contact angle. The contact angle is an angle formed by the surface of the cleaning target and the opposite face of the exit seal opposite the cleaning target, assuming that the exit seal, which is bent by contacting the cleaning target at the predetermined depth, is extended straight. To set the contact pressure of the exit seal, such as the exit seal 112*c*, with the cleaning target to not greater than the predetermined value, the exit seal has a certain length from the free end to the attached end. If the length of the exit seal from the free end to the attached end is short, when the free end of the exit seal contacts the cleaning target, the exit seal would not be bent well, thus increasing the contact pressure. If the length of contact angle is too large, the contact pressure of the exit seal with the cleaning target might increase. By contrast, if the contact angle is too small, the free end side of the exit seal closely contacts the cleaning target, thus blocking toner. Accordingly, the contact angle of the exit seal relative to the cleaning target is set to be a predetermined angle. As described above, when the exit seal having a certain length from the free end to the attached end is attached to the casing at a predetermined contact angle, the attached end of the exit seal is secured at a position away from the surface of the cleaning target at some distance. As a result, a space between the attached-end side of the exit seal and the cleaning target becomes large. Accordingly, the opening communicated with the outside at each lateral end of the exit seal is large at the attached-end side of the exit seal, thus causing toner to be scattered from a portion of the opening at the attached-end side of the exit seal. Hence, in Aspect 1, a portion of the opening at at least the attached-end side of the exit seal, such as the exit seal 112*c*, is sealed, thus preventing toner from being scattered from the opening at the attached-end side of the exit seal which is likely to be relatively large in design. By contrast, since the opening is narrow at the free end side of the exit seal, little toner is scattered from the free end side of the opening. Accordingly, sealing the opening at the attached-end side of the exit seal excellently reduces scattering of toner.

Aspect 2

The cleaning device according to Aspect 1 further includes a gap fill portion to fill a space between the surface of the cleaning target and at least an attached-end side of a lateral end of the opposite face of the exit seal, such as the exit seal 112*c*, opposite the cleaning target, such as the intermediate transfer belt 2. The attached-end side of the exit seal, such as the exit seal 112*c*, is sealed with the gap fill portion. As described in the above-described embodiments, such a configuration prevents toner in the casing from moving to a gap between the attached end side of the lateral end of the exit seal 112*c* and the cleaning target, such as the intermediate transfer belt 2. Accordingly, toner scattered from the opening communicated with the outside would pass a route in the lateral end of the exit seal, such as the exit seal 112*c*. That is, the gap fill portion blocks lateral movement of in the casing and toner moves into a slight gap between the cleaning target and the free end of the exit seal. Further, toner laterally moves in the slight gap, arrives at the opening, and is scattered from the opening. However, actually, little toner passes through the slight gap. Thus, such a configuration excellently reduces scattering of toner, thus preventing toner from staining in an apparatus.

Aspect 3

The cleaning device according to Aspect 2 further includes a side seal, such as the side seal 116*c*, disposed outside the lateral end of the exit seal, such as the exit seal 112*c*, in an axial direction, to seal a gap between a lateral end of the casing. The gap fill portion, such as the overlap portion 116*c*1, extends from the side seal, such as the side seal 116*c*, toward a center in the axial direction and overlaps with the lateral end of the exit seal in a vertical direction relative to the surface of the cleaning target. In this configuration, as described in the above-described embodiments, the gap fill portion seals a gap in the lateral direction between a lateral end face of the exit seal and each of a side face of the side seal and the casing. Such a configuration prevents toner from being scattered along the direction of movement of the surface of the cleaning target from the gap in the lateral direction between a lateral end face of the exit seal and each of a side face of the side seal and the casing. Further, attaching the side seal, such as the side seal 116*c*, to the casing allows the gap fill portion to be attached to the casing, thus facilitating assembly.

Aspect 4

In the cleaning device according to Aspect 2 or 3, the gap fill portion, such as the overlap portion 116*c*1, is disposed from an exit of a contact portion at which the cleaning target contacts the cleaner to an attached portion of the casing to which the attached end of the exit seal, such as the exit seal 112*c*, is secured. Such a configuration prevents the gap fill portion, such as the overlap portion 116*c*1, from hampering cleaning of the cleaner.

Aspect 5

In the cleaning device according to any one of Aspects 2 through 4, the gap fill portion, such as the overlap portion 116*c*1, includes at least an elastic layer. In this Aspect 5, the gap fill portion, such as the overlap portion 116*c*1, is configured to contact the cleaning target, such as the intermediate transfer belt 2, so that the elastic layer elastically deforms, thus more reliably filling the gap between the cleaning target and the lateral end of the exit seal, such as the exit seal 112*c*.

Aspect 6

In the cleaning device according to any one of Aspects 2 through 5, the cleaning target, such as the intermediate transfer belt 2, is an image bearer to bear a toner image within a toner image bearing region. The gap fill portion, such as the overlap portion 116*c*1, is disposed outside the toner image bearing region. Such a configuration prevents the gap fill portion, such as the overlap portion 116*c*1, from blocking toner on the image bearer, such as the intermediate transfer belt 2.

Aspect 7

The cleaning device according to any one of Aspects 1 through 6 further includes an entry seal, such as the entry seal 111*c*, attached to the casing and having a free end contacting the cleaning target at a position upstream from the cleaner in the direction of movement of the cleaning target and a side seal, such as the side seal 116*c*, disposed outside a lateral end of the entry seal in an axial direction, to seal a gap between a lateral end of the casing and the cleaning target. The side seal has an overlap portion overlapping with the lateral end of the entry seal in a vertical direction relative to the surface of the cleaning target. In this configuration, as described in the above-described embodiments, the side seal seals a gap in a lateral direction between a lateral end face of the entry seal and an opposite member opposite the lateral end face. Such a configuration prevents toner from being scattered from the gap in the lateral direction between the lateral end face of the entry seal and the opposite member opposite the lateral end face.

Aspect 8

In the cleaning device according to any one of Aspects 1 through 7, the exit seal, such as the exit seal 112*c*, is an urethane seal having a thickness of not less than 0.17 mm and not greater than 0.23 mm. In this configuration, the exit seal has a proper hardness, thus preventing the exit seal from blocking toner on the cleaning target, such as the intermediate transfer belt 2. Such a configuration also prevents the free end of the exit seal from being separated from the cleaning target by an airflow generated in the casing, such as an airflow generated by rotation of the cleaner.

Aspect 9

The cleaning device according to any one of Aspects 1 through 8 further includes a plurality of cleaning units. Each of the plurality of cleaning units includes the cleaner, the casing accommodating the cleaner, the exit seal, and the entry seal. The plurality of cleaning units are arranged in the direction of movement of the surface of the cleaning target. In the plurality of cleaning units, the exit seal of at least one cleaning unit and the entry seal of one cleaning unit adjacent to the at least one cleaning unit overlap with each other. As described in the above-described embodiments, such a configuration prevents scattered toner from entering between an upstream cleaning unit and a downstream cleaning unit, thus reducing staining of an apparatus.

Aspect 10

The cleaning device according to any one of Aspects 1 through 9 further includes an entry seal attached to the casing and having a free end contacting the cleaning target at a position upstream from the cleaner in the direction of movement of the cleaning target. A depth at which the exit seal contacts the cleaning target is not less than a depth at which the entry seal contacts the cleaning target. Such a configuration prevents the free end of the exit seal from being separated from the cleaning target, such as the intermediate transfer belt 2, by, e.g., an influence of elastic repulsive force of the gap fill portion, thus maintaining good sealing performance.

Aspect 11

According to Aspect 11, an image forming apparatus includes an image bearer, such as the intermediate transfer belt 2, having a surface to bear a toner image; a toner image forming device, such as the image forming station 66, the writing device 5, and primary transfer roller, to form a toner image on the surface of the image bearer; a transfer device, such as the secondary transfer device 9, to transfer the toner image on the surface of image bearer onto a transfer body; and the cleaning device according to any one of Aspects 1 through 10 to scrape off toner as adhered substance on the surface of the image bearer. Such a configuration prevents toner from being scattered from the cleaning device and staining the interior of the image forming apparatus.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A cleaning device comprising:

a cleaner configured to remove toner from a cleaning target;

a casing accommodating the cleaner; and an exit seal attached to the casing and having a free end contacting the cleaning target at a position downward from the cleaner in a direction of movement of the cleaning target and an attached end attached to the casing, a space disposed between a surface of the cleaning target and an opposite face of the exit seal opposite the cleaning target, the space including an opening at a lateral end of the exit seal, the exit seal contacting the cleaning target from a trailing direction of the exit seal and sealing the opening at at least an attached end side of the exit seal.

2. The cleaning device according to claim 1, further comprising a gap fill portion filling a space between the surface of the cleaning target and at least an attached end side of a lateral end of the opposite face of the exit seal opposite the cleaning target, wherein the gap fill portion seals at least the attached end side of the exit seal.

3. The cleaning device according to claim 2, further comprising a side seal disposed outside the lateral end of the exit seal in a lateral direction of the exit seal, to seal a gap between a lateral end of the casing and the surface of the cleaning target, wherein the gap fill portion extends from the side seal toward a lateral center of the exit seal.

4. The cleaning device according to claim 2, wherein the gap fill portion disposed from an exit of a contact portion at which the cleaner contacts the cleaning target to an attached portion of the casing to which the attached end of the exit seal is attached.

5. The cleaning device according to claim 2, wherein the gap fill portion includes an elastic layer.

6. The cleaning device according to claim 2, wherein the cleaning target is an image bearer configured to bear a toner image in an image bearing region, and wherein the gap fill portion is disposed outside the image bearing region.

7. The cleaning device according to claim 1, further comprising an entry seal attached to the casing and having a free end contacting the cleaning target at a position upstream from the cleaner in the direction of movement of the cleaning target; and a side seal disposed outside a lateral end of the entry seal in a lateral direction of the entry seal, to seal a gap between a lateral end of the casing and the surface of the cleaning target, wherein the side seal includes an overlap portion overlapping with the lateral end of the entry seal in a vertical direction relative to the surface of the cleaning target.

8. The cleaning device according to claim 1, wherein the exit seal is an urethane seal having a thickness of not less than 0.17 mm and not greater than 0.23 mm.

9. The cleaning device according to claim 1, further comprising:

an entry seal; and a plurality of cleaning units arranged in the direction of movement of a cleaning target, wherein each of the plurality of cleaning units includes:

the cleaner;

the casing accommodating the cleaner;

the exit seal; and the entry seal, wherein the exit seal of at least one cleaning unit of the plurality of cleaning units overlaps with the entry seal of one cleaning unit adjacent to the at least one cleaning unit.

10. The cleaning device according to claim 1, further comprising an entry seal attached to the casing and having a free end contacting the cleaning target at a position upstream from the cleaner in the direction of movement of the cleaning target, wherein a depth at which the exit seal contacts the cleaning target is not less than a depth at which the entry seal contacts the cleaning target.

11. An image forming apparatus comprising:

an image bearer having a surface to bear a toner image;

a toner image forming unit configured to form the toner image on the surface of the image bearer;

a transfer device configured to transfer the toner image from the surface of the image bearer onto a transfer target; and the cleaning device according to claim 1 configured to remove toner from the surface of the image bearer.

* * * * *